US008381460B1

(12) United States Patent
McDermott

(10) Patent No.: US 8,381,460 B1
(45) Date of Patent: Feb. 26, 2013

(54) EXTENDABLE BEAM STRUCTURE (EBS)

(76) Inventor: Patrick P. McDermott, Vienna, VA (US)

( * ) Notice: Subject to any disclaimer, the term of this patent is extended or adjusted under 35 U.S.C. 154(b) by 690 days.

(21) Appl. No.: 12/072,532

(22) Filed: Feb. 27, 2008

Related U.S. Application Data

(60) Provisional application No. 60/903,516, filed on Feb. 27, 2007.

(51) Int. Cl.
*E04H 12/34* (2006.01)

(52) U.S. Cl. ..... 52/118; 52/641; 52/649.5; 52/745.17; 52/117

(58) Field of Classification Search ..... 52/111, 52/632, 646, 117, 118, 121, 114, 116, 67, 52/79.5, 641, 645, 649.5, 745.17, 745.18; 343/875, 901, 874; 414/919; 187/242, 262
See application file for complete search history.

(56) References Cited

U.S. PATENT DOCUMENTS

| | | | | | |
|---|---|---|---|---|---|
| 125,771 | A | * | 4/1872 | Trego | 52/651.02 |
| 2,581,351 | A | * | 1/1952 | Black | 52/148 |
| 2,583,072 | A | * | 1/1952 | Wilson | 52/121 |
| 2,675,211 | A | * | 4/1954 | Regoord | 254/387 |
| 2,795,303 | A | * | 6/1957 | Muehlhause et al. | 52/121 |
| 3,248,831 | A | * | 5/1966 | Jones | 52/121 |
| 3,382,626 | A | * | 5/1968 | Bohr et al. | 52/108 |
| 3,486,279 | A | * | 12/1969 | Mauch | 52/108 |
| 3,611,652 | A | * | 10/1971 | Darnell | 52/110 |
| 3,751,863 | A | * | 8/1973 | Lyons | 52/111 |
| 3,771,274 | A | * | 11/1973 | Vaughan | 52/646 |
| 4,176,360 | A | | 11/1979 | Leavy et al. | |
| 4,212,015 | A | | 7/1980 | Graf et al. | |
| 4,231,200 | A | * | 11/1980 | Henderson | 52/111 |
| 4,309,854 | A | * | 1/1982 | Vendramini | 52/121 |
| 4,334,391 | A | * | 6/1982 | Hedgepeth et al. | 52/108 |
| 4,475,323 | A | * | 10/1984 | Schwartzberg et al. | 52/111 |
| 4,532,742 | A | * | 8/1985 | Miura | 52/108 |
| 4,580,377 | A | * | 4/1986 | Sundin | 52/121 |
| 4,662,130 | A | * | 5/1987 | Miura et al. | 52/108 |
| 4,785,309 | A | * | 11/1988 | Gremillion | 343/883 |
| 4,932,176 | A | | 6/1990 | Roberts et al. | |
| 5,014,484 | A | * | 5/1991 | Tanizawa et al. | 52/646 |
| 5,101,215 | A | | 3/1992 | Creaser, Jr. | |
| 5,154,027 | A | * | 10/1992 | Warden | 52/108 |
| 5,218,375 | A | | 6/1993 | Hillman | |
| 5,516,070 | A | | 5/1996 | Chapman | |
| 5,524,398 | A | * | 6/1996 | Miller et al. | 52/121 |
| 5,557,892 | A | * | 9/1996 | Lavin | 52/121 |
| 5,645,142 | A | * | 7/1997 | Kraemer et al. | 187/372 |
| 5,786,854 | A | | 7/1998 | Slade et al. | |
| 5,832,688 | A | * | 11/1998 | Crissey et al. | 52/651.01 |
| 6,046,706 | A | | 4/2000 | Vargas | |
| RE37,559 | E | | 2/2002 | Marue et al. | |
| 7,195,216 | B2 | * | 3/2007 | Wang | 248/157 |
| 2008/0066392 | A1 | * | 3/2008 | Sorensen | 52/79.5 |

FOREIGN PATENT DOCUMENTS

SU 815249 B * 3/1981

* cited by examiner

*Primary Examiner* — Robert Canfield
*Assistant Examiner* — Babajide Demuren
(74) *Attorney, Agent, or Firm* — James Creighton Wray

(57) ABSTRACT

An extendable beam has compact slideable segments with angular extensions connected by cables which are tensioned to strengthen the beam when the beam is extended by sliding the segments. Restraining parts slide along tracks on neighboring segments. Short fixed length cables are connected between tips of extensions and diagonally between extension tips and segments are tensioned when hinged extensions are deployed. Other cables are paid out and tensioned, connecting tips of extensions on adjacent segments. Internal pulleys and beam extension cables simultaneously slide adjacent segments to extend the beam. An external crane and lock extend the beam serially.

36 Claims, 23 Drawing Sheets

EXTENDABLE BEAM STRUCTURE (EBS)

This application claims the benefit of U.S. Provisional Application No. 60/903,516 filed Feb. 27, 2007.

SUMMARY OF THE INVENTION

The invention described herein relates to an Extendable Beam Structure (EBS) that is relatively lightweight and very compact when stowed, but extendable into a long stiff beam structure for both space and terrestrial applications. The EBS, with a telescoping central beam, is stabilized with a network of cables in tension, and standoff members in compression, like the orthogonal structural stays, known also as spreaders, attached to sailboats masts. These stays hold shroud lines running parallel to but offset from the mast in order to increase its stiffness and prevent the mast from excessive bending in high winds. The telescoping central beam is extended by means of cables and pulleys that extend and contract the beam with motor driven winches, with cables played out from the tips of the stays during the extension process, to maintain stiffness during deployment. A variety of fixed length diagonal cables provide additional lateral stability.

The EBS differs from previous telescoping masts or towers in several important ways. Conventional telescoping masts, antennas or towers utilize a plurality of nested tubes with a larger diameter tube at the base and sequentially decreasing diameter tubes that are stowed within each other then extended through various means to form the mast or tower. Various techniques have been used in the past to extend these mast structures: hydraulic, pneumatic and mechanical. In mechanical systems, cables and pulleys are used to extend and contract the masts. In addition to cylindrical shapes for the nested mast segments, there are a variety of shapes possible, triangular, and rectangular being the most prominent. Some of the extended tower structures are further stabilized structurally with diagonal cables from the top or midsection of the tower to the ground.

The EBS relies on certain elements of the prior art like a telescoping central beam structure, which is extended by means of cables and pulleys, with optional diagonal cables secured to the ground. But the EBS differs in a number of important features that allow for much larger payloads to be supported in the case of a tower, with a central beam design that is relatively light weight compared to other conventional extendable masts. In many descriptions of the prior art only one strand of cable is used to extend the mast. In the EBS, the design allows for many turns of cable in a compound pulley system that allows for substantial forces to be applied to the beam extension.

In traditional extendable masts or towers, the cylindrical, triangular or rectangular telescoping members must be relatively stout in order carry the weight of the payload, but also to prevent bending or flexing since the mast is essentially a long narrow structure with a high length to diameter ratio. This tendency to bend or flex must be countered by the strength of each of the telescoping members, which adds considerable weight. Furthermore, the wall thickness of the telescoping members somewhat limits the number of members that can be embedded one within the other when the system is in a stowed configuration. This limitation is further complicated by the addition of seals in the case of hydraulic or pneumatic systems, and spaces for cables and pulleys in the mechanical system.

In the case of the EBS, central beam is an open system, as will be seen in following figures and discussion. Rather than closed cylinders, triangles or rectangular shaped tubes, the beam segments of the EBS are stiffened plates laid up next to each other with pulleys and cables sandwiched between the plates, such that up to 20 or more segments can easily be accommodated by the designs.

The EBS is unique in that the compressive axial loads are borne by the central beam, but the bending moments on the central beam are countered by the outrigger stays and cables, acting in a manner similar to that utilized on sailboats to lightweight the mast, but also provide necessary strength. The side view of the EBS is similar to that of a typical TV tower with a triangular or rectangular cross section made up of welded pipes or angle irons. In the case of the EBS the outer members are not pipes or angle irons, but rather cables in tension. Therefore, only the central beam need be a substantial stout structure, the rest of the support being a network of relatively light weight cables and stays.

In space applications, the EBS can be deployed robotically to unfold large antennas or solar arrays, and/or provide substructural-members for building or extending platforms in space. On the ground, there are numerous terrestrial applications possible, like extendable towers, hereafter referred to as the Power Tower (PT), capable of lifting moderate to heavy payloads to hundreds of feet of altitude. Power Tower can be used for radio or TV broadcasting, signal direction finding, a platform for surveillance cameras, border protection, weather data collection, environmental monitoring, emergency lighting, high altitude firefighting equipment, high altitude scaffolding, and support for wind turbines. Horizontal terrestrial applications include portable bridging. The value of EBS is its portability, in that it can be stowed and deployed within a matter of minutes to perform functions that are normally performed by permanent structures or a scaffold-type structure like very tall vertical cranes that take hours or days to assemble.

The EBS is scalable in terms of size, weight and extension length. For antenna masts with relatively light payloads, the central beam could be very light weight and may not require diagonal anchoring cables. Lighter weight versions could be mounted on a truck or other vehicle as will be seen in later figures with the central beam incorporated in the body of the truck with nested stays incorporated in the roof.

The following EBS description for the sake of convenience is described with reference to the Power Tower where parts of the EBS can be described in terms such as top and bottom, horizontal and vertical. The principals of deployment, however, are the same for the EBS regardless of orientation to gravity as might occur, for example, in a deployment in space or horizontal structures like bridges. FIG. 1 shows the deployment of a vertical Power Tower starting with a relatively small, stowed package 1 with a nominal payload 2 *a* radome, shown in FIG. 1*a*. FIGS. 1*b* through 1*e* show the stages of deployment where the stays 3 stowed parallel to the central beam, initially, are rotated outward containing a radar antenna from the stowed package. The EBS includes:

(1) Central Beam Structure (CBS) which contains a number (N) of Beam Segments (BS), essentially a set of long narrow rigid members (length to width of approximately 10:1 to 20:1) with pulleys at each end, aligned in parallel when stowed, and able to slide upward past each other during deployment like a telescope, such that the length of the extended beam is N times the length of each segment BS, minus a small portion of the segment at each end (5-10% of length) for a pulley mechanism to extend the beam;

(2) Central Beam Extension System composed of a single continuous Beam Extension Cable (BEC) routed between each BS through Beam Extension Pulleys (BEP) at each end of the beam segments and routed from one BS to the adjacent BS such that when the cable is retracted, there is an extending force exerted between each segment that forces them to move past each other and extend the CBS to its full length. A separate Beam Retraction Cable (BRC) runs directly from the payload level at the top, to the base, providing the necessary tension to retract the EBS.

(3) Standoff Stays (SS) approximately the same length as each BS and linked via a rotating joint to the bottom or top of each BS and stowed parallel to the BS, then during the deployment process rotated outward and upward or downward depending on the variant until perpendicular to the central beam structure, with multiple stays (2, 3, or 4) at each level depending on the EBS variant.

(4) Structure Stabilizing Cable Networks composed of sets of fixed and extendable cables attached to central beam and the tips of each stay that provide stability and rigidity to the CBS when deployed as follows.

(a) BS to SS Fixed-Length Cables (BSF) runs from the tip of a stay to the opposite end of the beam segment to which the stay is attached. This cable is slack when in the stowed position; but is stretched taut when the stay is rotated 90 degrees, maintaining the stay in a perpendicular orientation around a rotatable joint linking the base of the stay to the beam segment.

(b) SS to SS Fixed-Length Cables (SSF) connecting the tips of adjacent stays connected to a single beam segment when the stays are in plane (SSFi), or out of plane (SSFo) as in the case where one stay is attached one end of the BS and the adjacent stay is at the opposite end of the same BS. In the case of the SSFi, the both the stays and the fixed cables are in the same horizontal plane, which itself is orthogonal to the vertical BS. In the out-of-plane case the cable from one stay tip to the adjacent stay tip not vertical or horizontal, but a diagonal from tip to adjacent tip. As with the BSF, these cables are slack when the stays are stowed but are stretched taut when the stays are rotated into the perpendicular position.

(c) SS to SS Extendable Cables (SSE) connecting an SS attached to one BS to the SS attached in like manner, but to the adjacent BS such that when the multiple beam segments are extended during deployment, the SSE are played out from each SS to the adjacent SS in the vertical direction, parallel to the vertical axis of the extending BS, with the amount of cable played out from SS to SS equal to the length of each BS extension such that the stays remain perpendicular to the extending central beam CBS.

(5) Mechanisms for Controlling the Beam extension and Retraction Process. There are several possible modes of for extending and retracting the EBS: a) Random where each BS is extended randomly with no control over the process; b) Sequential where each BS is extended separately and sequentially with latching methods to control the sequence; c) Simultaneous, the preferred method, where each BS is extended in a simultaneous but controlled manner such that there is equal distance between each level as it ascends and descends. This last mode requires a unique cable system, the Beam Control Cable (BCC), which will be described later in more detail.

(6) Additional Anchoring Cables In the case of PT, Interior Anchoring Cables (IAC) connect the lower level of stays to the ground at the base of the EBS, and Exterior Anchoring Cables (EAC) provide additional support from the top and midsections of the EBS to ground anchoring points away from the base of the central beam if necessary to provide stability against high winds. This exterior anchoring system is not necessary in the case of a deployment in space and optional in certain terrestrial applications where CBS length, orientation, or payload do not require it.

(7) Motorized Winches and Tensioning Mechanisms in the base of the EBS play out and retract the continuous Beam Extension Cable (BEC), the Beam Retraction Cable (BRC); the Beam Control Cable (BCC): and the Anchoring Cables (AC). All four cabling systems must be synchronized in terms of the lengths of cable played out and retracted. One motor can control all of the four winches with reduction gearing to compensate for the differences in the lengths of cable and the mechanical advantages inherent in each cabling system. During the extension process cables can be loosened slightly to reduce friction, and then tightened at the end of the extension process to increase stiffness.

(8) Simplified Semiautonomous Beam Extension—Not all of the features described above for the fully autonomous EBS must be incorporated into variants which for the sake of simplicity and cost could be employed to extend the EBS through means other than those described above. While maintaining the principles of stays and vertical extendable cables, fixed horizontal and diagonal cables, a simplified, hereafter referred to as a Semiautonomous Beam Extension System, (SBES) is able to elevate the EBS Without the need for the Beam Extension Cable and Pulleys, the Beam Control Cable and Pulleys, and the complex Motorized Winch and Tensioning Mechanism described in paragraph (7). This Semiautonomous Beam extension System relies on an external lifting mechanism (winch, mechanical jack, hydraulic lift, etc.) to raise each BS sequentially, locking the bottom of the first BS with the top of the adjacent BS, then lifting both a point where the bottom of the second BS is locked to the third BS and so on until all of the BS are extended.

The retraction process encompasses a reverse process with the bottom of next to last BS unlocked from the top of the BS at the base of the EBS tower, then lowered by the SBES external mechanism to the base, wherein the BS originally third from the bottom is unlocked and lowered to base, and so on until the PT is totally retracted.

The SEES system is more labor intensive and would require more manual activity by operators, to attach lifting mechanism and secure the locking mechanisms, but is offered as an alternative, less extensive and possibly more reliable methodology if capitol cost is a factor, and if the erection/retraction of the PT is infrequent.

These and further and other objects and features of the invention are apparent in the disclosure, which includes the above and ongoing written specification, with the drawings.

BRIEF DESCRIPTION OF THE DRAWINGS

FIG. 1*a* shows the PT in stowed transportable confirmation.

FIG. 1*b* shows the PT in being configured for deployment where packages of nested stays are rotated outward away from the stowed cluster of beam segments.

FIG. 1*c* shows the payload platform attached and raised up in order to tension the top level beam to stay fixed diagonal cables. FIGS. 1*d* and 1*e* show PT at mid and full extension.

FIG. 6*a* is the beam core of the simplest variant, essentially a long flat plate, with alignment tracks.

FIG. 6*b* shows beam core in the shape of a "V" to improve beam stiffness.

FIG. 6*c* shows a top view of the upper end of the BS with pulleys and cable attachment points for a "high hat" shaped core.

FIG. 6*d* is a top view of the lower end of the BS, including the lower beam extension pulleys and stay attachment points.

FIG. 7*a* is a top view of the upper level of the three nested beam segments similar to that shown in FIG. 6*c*.

FIG. 7*b* shows the top view of the lower level of the three nested beam segments similar to that shown in FIG. 6*d*.

FIG. 7*c* is a front view of the lower beam with pulleys.

FIG. 7*d* is a side, edge view of the lower beam with pulleys.

FIG. 7*e* is a frontal view of the upper beam with pulleys.

FIG. 7*f* is a side view of the upper beam with embedded pulleys.

FIG. 7*g* is a magnified view of the extension cable crossover points.

FIGS. 15*c*, 15*e* and 15*g* show a composite top view of the lower platforms.

FIG. 20*a* shows a top view of two packages of nested beam segments.

FIGS. 20*b* and 20*c* show the two packages of beam segments being separated with rigid hinged stays.

FIG. 20*d* also shows a perspective view of a twin beamed bridge substructure with nested stay structures deployed.

FIG. 22*b* illustrates a fully extended bridge prior to its placement on the opposite shore.

FIG. 22*c* is a side view of the truck illustrating deployment of the roadbed segments.

FIG. 23*a* is a side view of the stowed package with the rolled up PV membrane and deployment structure.

FIG. 23*b* is a front view of the stowed array with a rolled up PV membrane, rigid truss beams on each lengthwise side of the drum, EBS structures at each end of the drum, and a roller bearing allowing the drum to rotate during deployment.

FIG. 23*c* shows the initial deployment of the EBS with robotic rotation of the leading stays and trailing stays at each end of the drum, stretching taut fixed length diagonal cables and extendable cables.

FIGS. 23*d* and *e* show respectively the solar array system in mid and full deployment.

DETAILED DESCRIPTION OF THE DRAWINGS

Figure 1E:
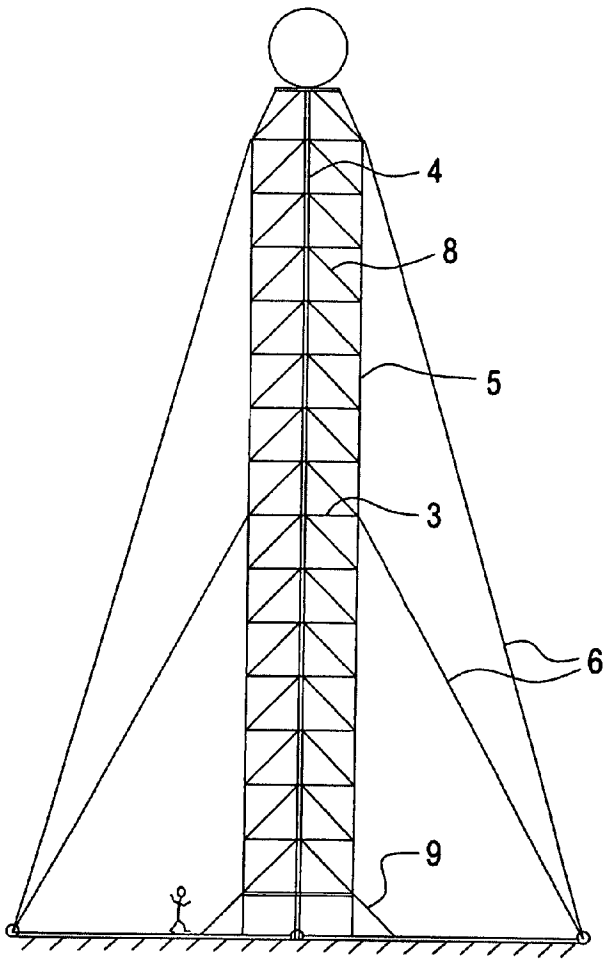
FIGS. 1*a-e* show an overview of the EBS as a vertical tower (Power Tower-PT), with payload.
Figure 1D:
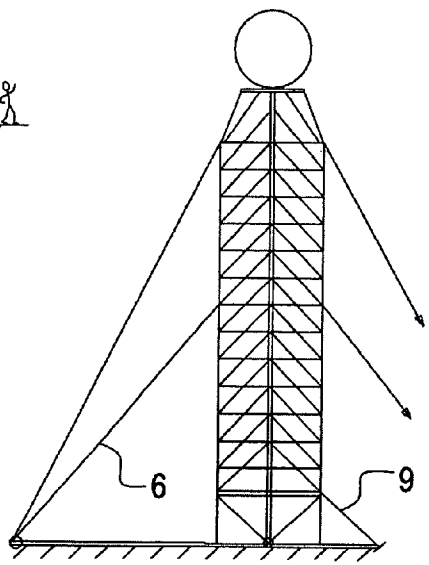
Figure 1A:
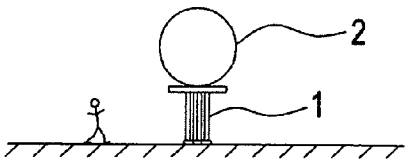

FIG. 1 shows the deployment of a vertical Power Tower starting with a relatively small, stowed package 1 with a nominal payload 2 *a* radome, shown in FIG. 1*a*. FIGS. 1*b* through 1*e* show the stages of deployment where the stays 3 stowed parallel to the central beam, initially, are rotated outward containing a radar antenna from the stowed package.

Figure 1B:
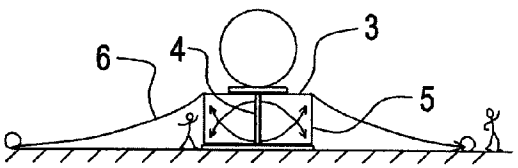

FIGS. 1*a-d* show an overview of the EBS as a vertical tower (Power Tower-PT), with payload. FIG. 1*a* shows the PT in stowed transportable configuration 1 with an attached payload 2, in this case a representation of a radar antenna within spherical dome. FIG. 1*b* shows the PT in being configured for deployment where packages of nested stays (SS) 3 are rotated outward away from the stowed cluster of beam segments BS 4, until perpendicular to the vertical axis, stretching taut the first stay to stay extendable vertical cable SSE 5, with the exterior anchoring cables EAC 6 attached to the ground away from the base of the EBS.

Figure 1C:
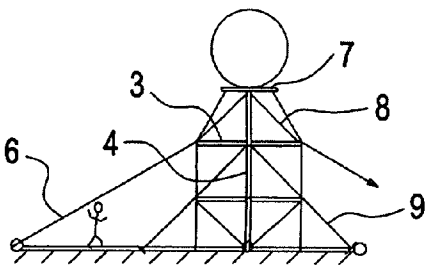

In the second phase of pre-deployment, shown in FIG. 1*c*, the payload platform 7 attached to the top-most BS 4 is raised up in order to tension the top level beam to stay fixed diagonal cables BSF 8 that are attached to the tips of the top layer of stays SS3 and maintain them in horizontal orientation prior to full deployment. Likewise, the bottom most BS 4 is fully extended downward to tension interior anchoring cables IAC 9. Once these interior anchoring cables are firmly fixed to the ground, the full extension of the EBS can begin central beam segments BS 4 propelled past each other by the beam extension subsystem described later telescoping upward as shown in mid-deployment, FIG. 1*d* and full deployment with FIG. 1*e*. The fully extended central beam 4, is stabilized by horizontal stays SS 3 and a network of diagonal cables BSF 8 and vertical cables SSE 5. Exterior anchoring cables EAC 6 provide support to the top and midsection of the EBS, and the base anchoring cables BAC 9 providing further ground level support to the bottom most level of stays 3.

Figure 2A:
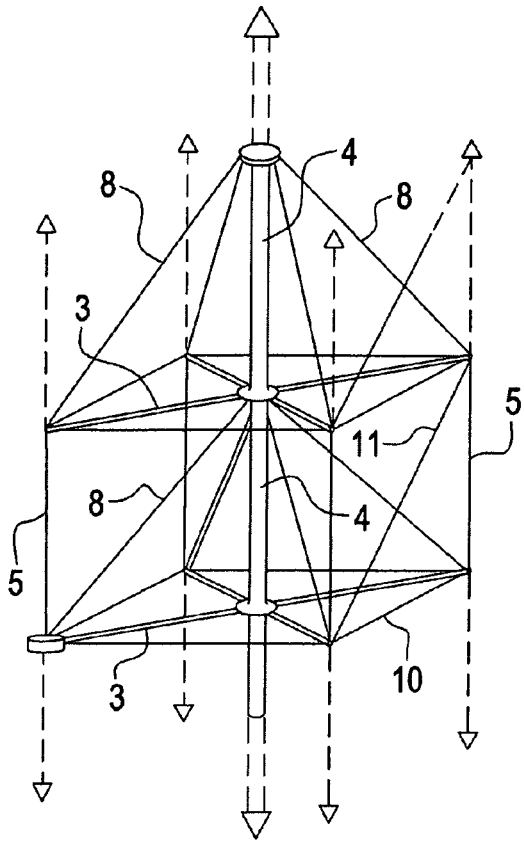
FIG. 2*a* is a perspective view of two levels of the EBS with all cables and stays deployed.

FIG. 2*a* is a perspective view of two levels of the EBS showing: two beam segments BS 4 each with four structural stays SS 3 in the same horizontal planes; vertical extendable cables SSE 5 connecting the tips of the stays vertically; fixed diagonal cables BSF 8 connecting stays to adjoining beam segments BS 4; fixed in-plane horizontal cables SSFi 10 connecting the stay tips in the same horizontal plane; fixed out-of-plane diagonal cable SSFo 11 connecting a stay tip at one level, to an adjacent stay tip at the next higher level. The dotted lines and arrows indicate connections to levels above and below the illustrated beam segment.

Figure 2B:
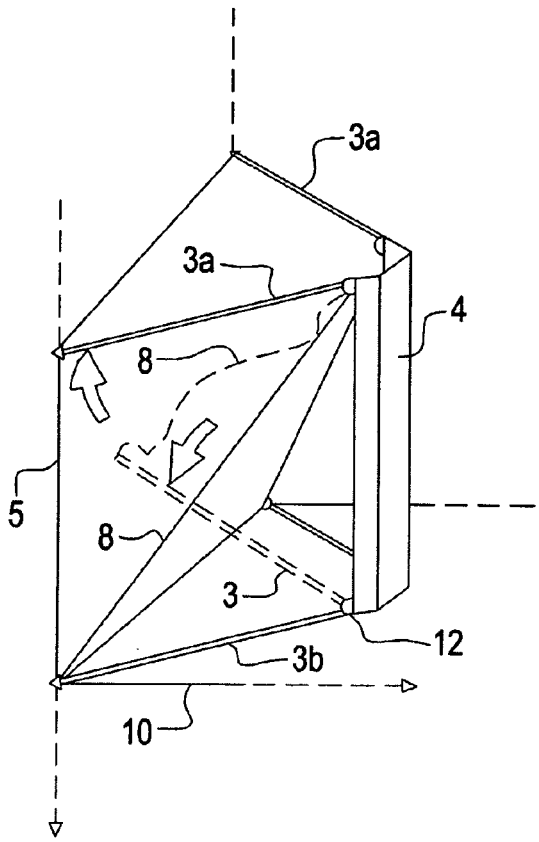
FIG. 2*b* illustrates the deployment of a single pair of stays.

FIG. 2*b* illustrates the deployment of a single pair of stays SS3 which are rotated away from a single beam segment BSM4 around rotatable joint 12 to secure the stay in a perpendicular position relative the to BS, by tensioning of the fixed cable BSF 8 at 90 degrees. The figure shows also the stay SS3 in mid rotation as dotted lines with the un-tensioned fixed-length cable BSF 8 shown as a curved dotted line before it is pulled taut.

Figure 2C:
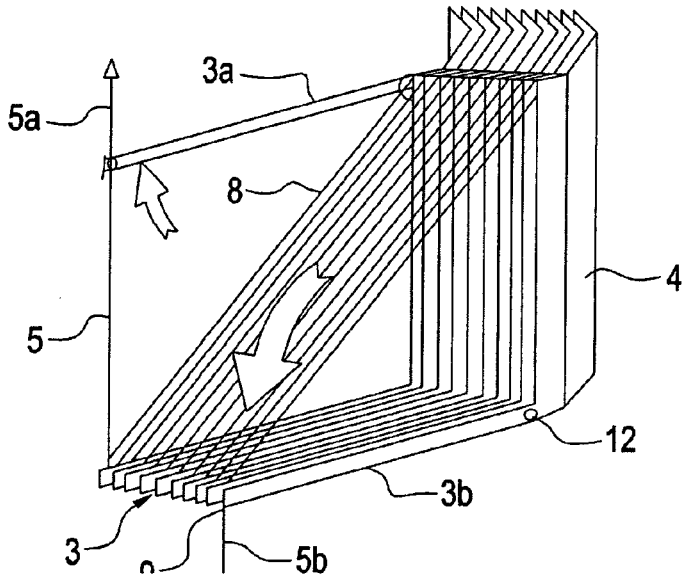
FIG. 2*c* shows the initial deployment phase as shown in FIG. 1*b*, with, however a full complement of nest beam segments and stays, with nested stays rotated downward, tensioning the diagonal cables.

FIG. 2*c* illustrates that the EBS is composed of multiple BS 4 and SS 3, which are nested together in parallel in the stowed configuration, then rotated manually or robotically outward in order to accomplish the stabilized beam extension. FIG. 2*c* shows the initial deployment phase as shown in FIG. 1*b* when the multiple stays 3 nested together in a package, are rotated together downward in the counterclockwise CCW direction until the multiple BSF 8 cables are made taut, with the topmost stay SS3 shown as 3*a*, rotated clockwise CW and attached to the top most level of EBS, the payload platform, through fixed cable 5*a*, This action stretches taut the leading vertical cable shown as 5. Likewise during the initial deployment the bottommost stay SS3 attached to the BS4 at the opposite end of the BS nested stack in the stowed package shown as 3*b* hereafter referred to as the trailing stay, is affixed to the ground via fixed length cable 5*b*. The extension of the bottom beam segment shown in FIG. 2*c* stretches taut cable 5 as well as the interior anchoring cables IAC 9.

Central Beam Extension Subsystem

Figures 3A, 3B:
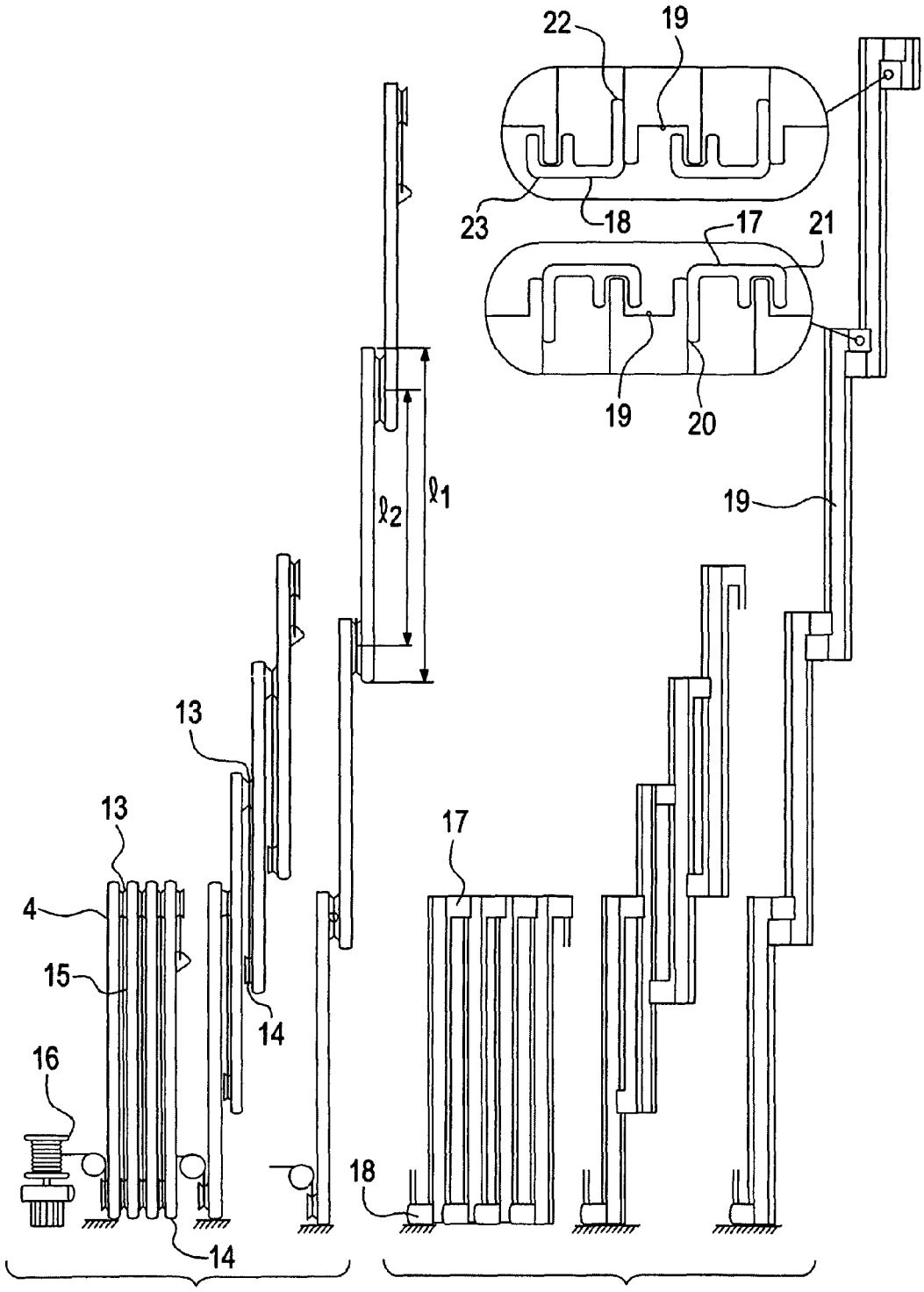
FIG. 3*a* shows a side view of a cluster of four nested beam segments illustrating the beam extension cable and pull in various stages of extension.
FIG. 3*b* shows a side view of the same four nested beam segments illustrating how adjacent beam segments are connected together via alignment guides.

FIGS. 3*a* and *b* shows the central beam extension subsystem BES in stowed form, mid deployment, and fully deployed. FIG. 3*a* shows a cluster of four nested beam segments with a set of beam extension pulleys 13 at the top of each BS 4, and a set of pulleys 14 at the bottom of each adjacent beam segment BS 4, with the continuous extension cable BEC 15 sandwiched between each BS pair. The number of pulleys and winds of cable between the upper and lower pulleys determines the force contracting the two sets of pulleys as winch 16 reels in the BEC 15. The BEC is routed between BS pairs via transition pulleys shown in subsequent figures.

When pulleys 13, for example, at the top of $BS_1$, are connected via continuous cable 15 through the pulleys 14 at the opposite end of the adjacent segment $BS_2$, a force is generated to move to the two segments past each other when the BEC is retracted at the base of the EBS until the pulleys at one end of $BS_1$ will meet the pulleys at the opposite end of $BS_2$ at full deployment. The right most drawing in FIG. 3*a* shows the fully extended four segment EBS where the total height of the EBS is 4 times the length between the sets of pulleys ($l_2$) when the BEC is fully retracted and the EBS is fully extended. Length ($l_2$) because of the space required for the pulleys is slightly less than the length of each BS ($l_1$).

FIG. 3*b* shows a different feature of the beam extension subsystem BES, which is the means by which adjacent beam segments are connected to each other with alignment guides at the outer edges of each BS. One set of alignment guides is attached to the top of each BS 17 and the other set at the bottom 18. At the top of FIG. 3*b*, there is illustrated a magnified view of the alignment track system 19 shown from a top view as a trough like structure along the edge of each BS, with alignment guides 17 affixed to the tops of each BS at point 20, with the opposite side of the alignment guide gripping the alignment track 19 of the adjacent BS 4 at point 21. The upper illustration shows alignment guides 18 affixed to the bottom of each BS 4 at point 22, with the opposite side of the alignment guide gripping the alignment track 19 of the adjacent BS 4 at point 23. Note the alignment tracks must be sufficiently wide such that the alignment guides do not interfere with each other as they pass by each other during beam extension.

As shown in the FIG. 3*b*, the alignment guides are shown as metal fixtures gripping alignment tracks. For larger applications, these alignment guides could contain rollers to reduce the metal on metal friction.

Semi-Autonomous Beam Extension Subsystem (SBES)

As mentioned previously, not all of the features above for the fully autonomous EBS must be incorporated into variants, which for the sake of simplicity and cost would not require the elaborate internal beam extension subsystem. FIGS. 3*c* through 3*h* show how an external winch 16*a* could be employed to extend the EBS by means of a cable 16*b* through structure 16*c* with 16*b* routed through pulleys 16*e* and 16*f*. Cable 16*b* is attached to the bottom of each BS via attachment point 16*g* wherein the BS is raised until the bottom of the BS is in the vicinity of the top of the adjacent BS, at which point, the bottom of one BS is locked into place.

Figure 3G:
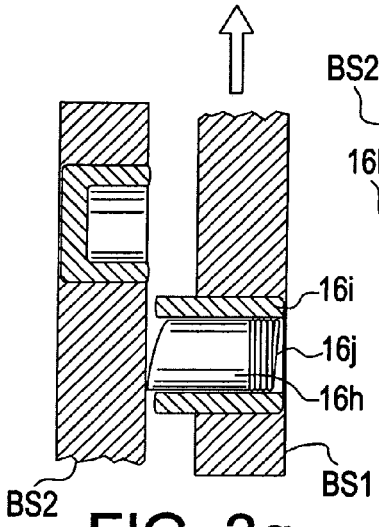
FIGS. 3*c* through 3*h* show three beam segments of the alternate semiautonomous beam extension subsystem sequential elevation process, the locking mechanism.
Figure 3H:
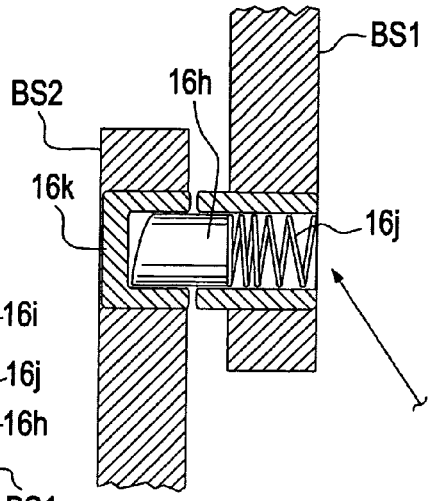
Figures 3C, 3D:
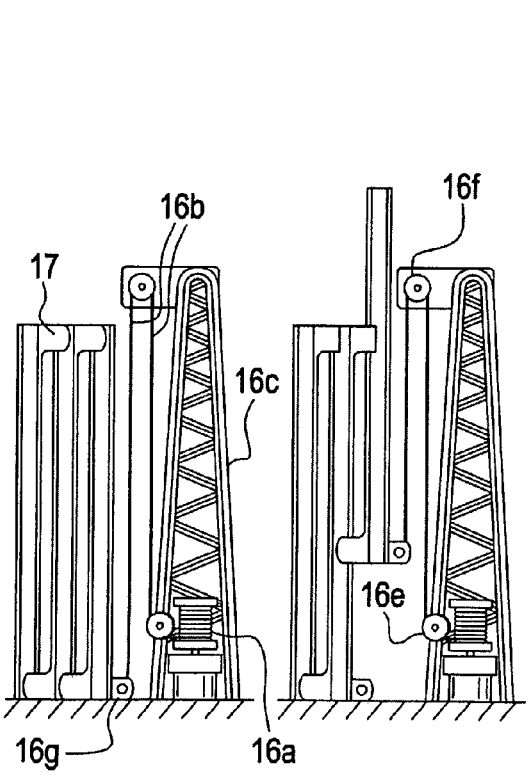

FIGS. 3*c* though 3*f* illustrate the sequential elevation process. In FIG. 3*c*, cable 16*b* is attached to 16*g*. FIG. 3*d* shows the first BS in mid elevation.

Figures 3E, 3F:
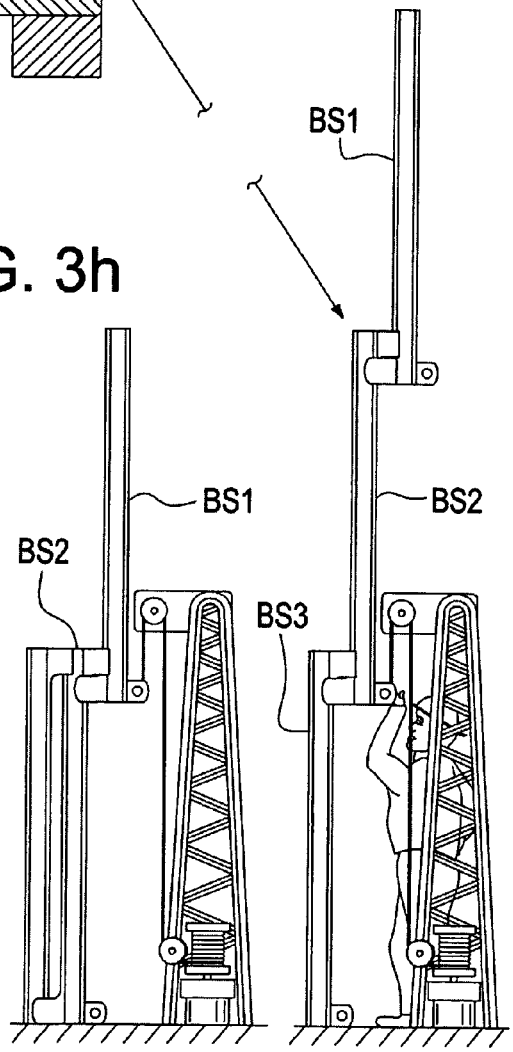

FIG. 3*e* shows the bottom of BS1 reaching the top of BS2 at which place the BS1 is locked to BS2 via a mechanism shown in FIGS. 3*g* and 3*h*.

There are many possible locking mechanisms for securing the beam segments. FIG. 3*g* shows one such mechanism, wherein a cylindrical bolt 16*h* is held in place by a cylindrical sleeve 16*i*, and is pressed against BS2 by means of compressed spring 16*j*. As BS1 travels upward relative to BS2, it reaches a level shown in FIG. 3*h*, where bolt 16*h* is thrust into a retaining cup, designated 16*k*. This bolt action secures BS1 and BS2 in the vertical direction.

FIG. 3*f* shows the process repeated where the bottom of the BS1/BS2 combined segments is locked into the top of BS3. FIG. 3*f* also shows an operator disengaging cable 16*b* so that it can be recycled downward to engage the next adjacent BS until all of the segments are elevated.

The retraction process encompasses a reverse process with the bottom of next to last BS unlocked from the top of the BS at the base of the EBS tower, then lowered by the SBES external mechanism to the base, wherein the BS originally third from the bottom is unlocked and lowered to base, and so on until the PT is totally retracted. The SBES system is more labor intensive and would require more manual activity by operators, but may be more cost effective for those situations where elevations and retractions are infrequent since it eliminates the many pulleys and cables associated with the autonomous beam extension system.

Dual Central Beam System

Figure 4A:
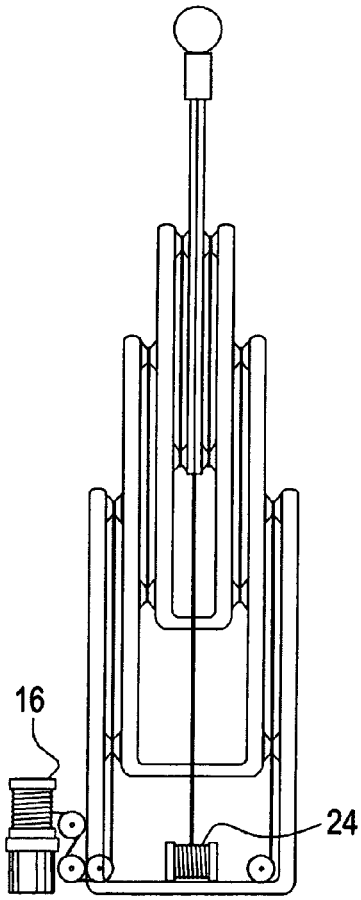
FIGS. 4*a* and 4*b* show a dual opposing central beam system CBS variant in mid and full extension, with extension and retraction cables and winches.
Figure 4B:
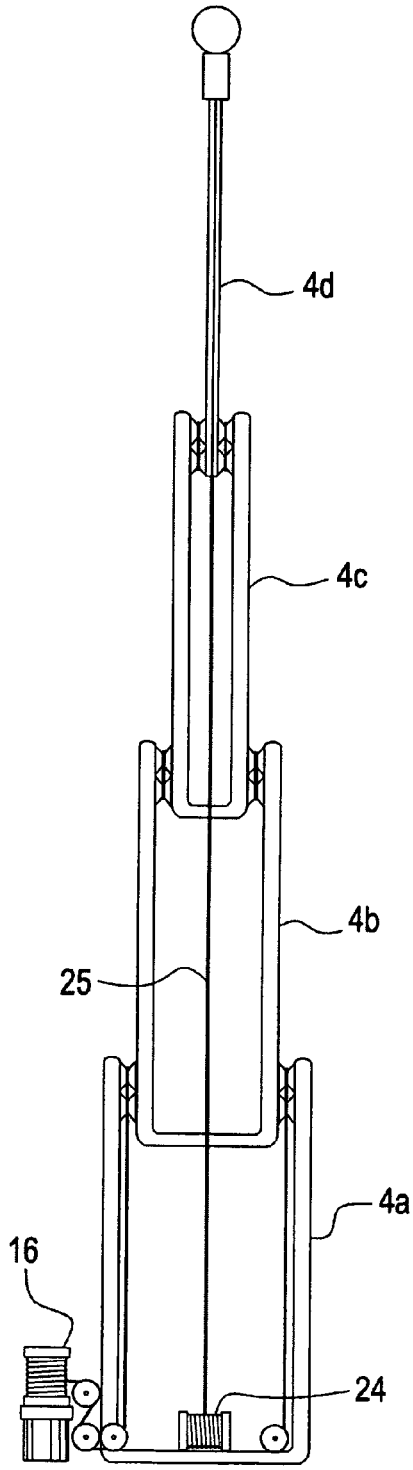

FIGS. 4*a* and 4*b* shows a dual central beam system CBS variant in mid and full extension. The dual system consists of two extending beams as shown in FIG. 3*a* back to back, with the separate extension cables sharing the same winch 16. FIG. 4*b* shows the side view deployment of the dual central beam segments with the innermost pair of beam segments 4*d* elevating away from the second pair 4*c*, the second away from the third 4*b* and the third away from, the fourth 4*a*.

In order to maintain tension on all of the cabling being retracted by winch 16, a separate winch 24 is connected to the Beam Retraction Cable (BRC) 25 running directly from the payload level at the top to the base, providing the necessary tension to retract the EBS with cable from winch 16 allowed to play out as BRC 25 is retracted.

This dual beam system allows for 4 stays to be supported at each level as shown in FIG. 2*a* without obstruction from adjacent stays and cabling systems as will be discussed in detail in later paragraphs.

Extendable Stay to Stay Vertical Cable Subsystem

Figure 5A:
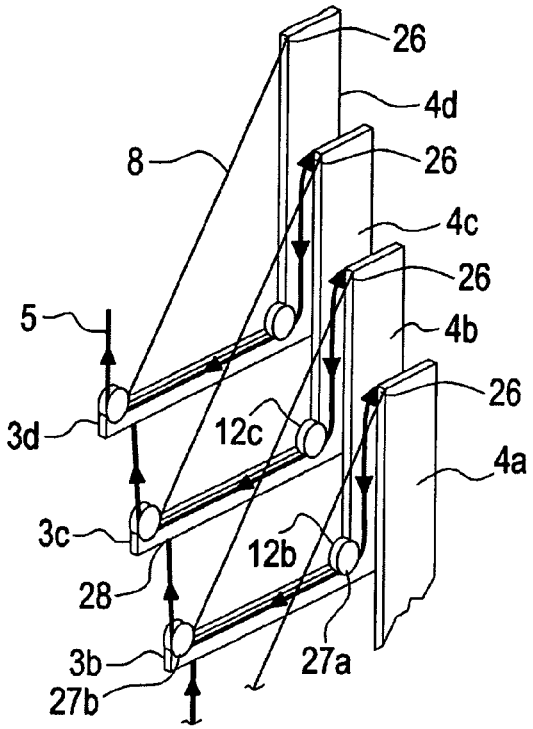
FIGS. 5*a* and 5*b* are perspective views of four BS segments of an EBS in early and later phases of deployment illustrating the stay-to-stay vertical cable deployment mechanisms.
Figure 5B:
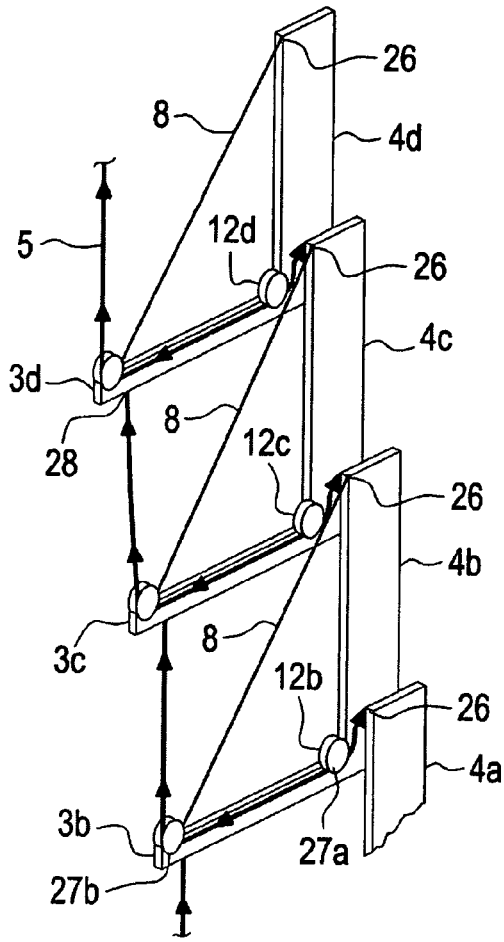

As illustrated in previous figures there are diagonal cables BSF 8 and fixed in plane horizontal cables SSFi that are stretched taut during the initial deployment phase, and extendable vertical cables SSE 5, and can vary in length depending on degree of elevation of the EBS. The mechanism for extending and contracting the vertical extendable cable SSE 5 is illustrated in FIG. 5. FIGS. 5*a* and 5*b* are perspective views of four BS segments of an EBS in early and later phases of deployment showing diagonal cables BSF 8 stretched taut with stays SS 3 rotated in the perpendicular position relative to the beam segments BS 4, with the extendable cable SSE 5 routed from an attachment point 26 at the top of the first beam segment BS 4*a* through an interior pulley 27*b* at the rotary joint 12*b* of the adjacent beam segment BS 4*b*, through pulley 27*b* at the tip of stay SS 3*b* to attachment point 28 on the tip of stay SS 3*c* which is attached to adjacent BS 4*c* through the rotatable joint 12*c*.

The net result of this mechanical system is to play out SSE 5 cable to lengths which are equal to the lengths in elevation of the beam segments BS 4 as the multiple BS slide past each during the EBS elevation. When the EBS is retracted, the reverse process occurs, that is, the vertical cables SSE 5 contract in direct proportion to the contraction of the beam segments. This mechanical system assures that the stays remain perpendicular to the attached beam segment as the EBS is raised and lowered, and maintains enough tension in the outer cable network to assure that the whole structure is stabile during elevation and retraction of the EBS.

Figure 5C:
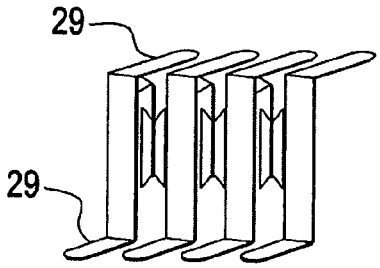
FIGS. 5*c* and 5*d* are side views of the nested stays in the stowed position and mid-deployment.
Figure 5D:
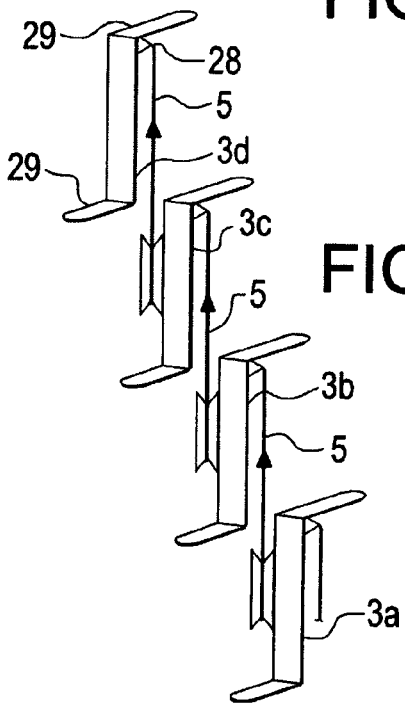

FIGS. 5*c* and 5*d* are side views of the nested stays in the stowed position (FIG. 5*c*) and mid-deployment (FIG. 5*d*). In order to increase the stiffness against bending moments, since the stays are long narrow structures, the stays SS 3 may have angled extensions of the stay top and bottom to increase stiffness at points 29 placed in such a manner that they too are nested in the stowed position and do not interfere with cables SSE 5 or BSF 8 as the EBS is elevated.

Stay to Stay Diagonal Cable Subsystem

In order to counteract torsion moments in the fully extended beam structure, it might be advantageous to add diagonal fixed cables from one stay tip to an adjacent stay tip, at different levels as shown in FIG. 2*a* as cable 11, also referred to in the text as Stay to Stay Out of Plane fixed cable SSFo. As described previously, cables 8 and 10 are made taut by the rotation of the nested stays. Cables 11 will remain slack during the elevation of the EBS, until the final extension, at which point the Cables 11 will be made taut.

Integration of Central Beam, Pulleys, Cables and Stays

Figure 6A:
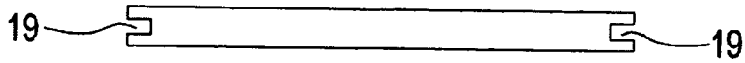
FIGS. 6*a-d* show top views of central beam variant and hardware associated with the central beam.
Figure 6B:
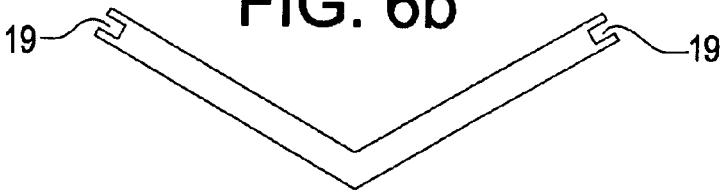
Figure 6C:
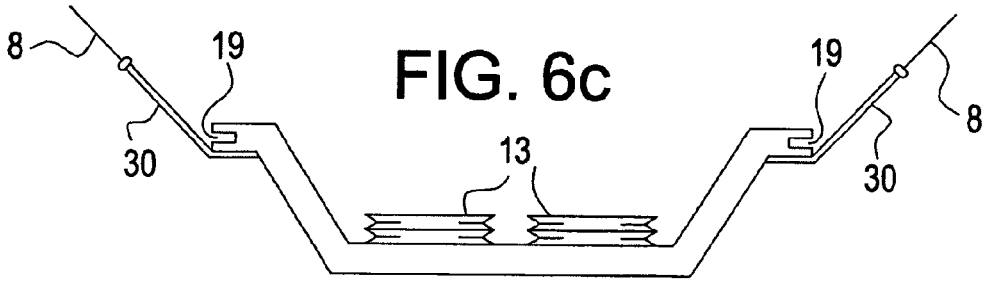
Figure 6D:
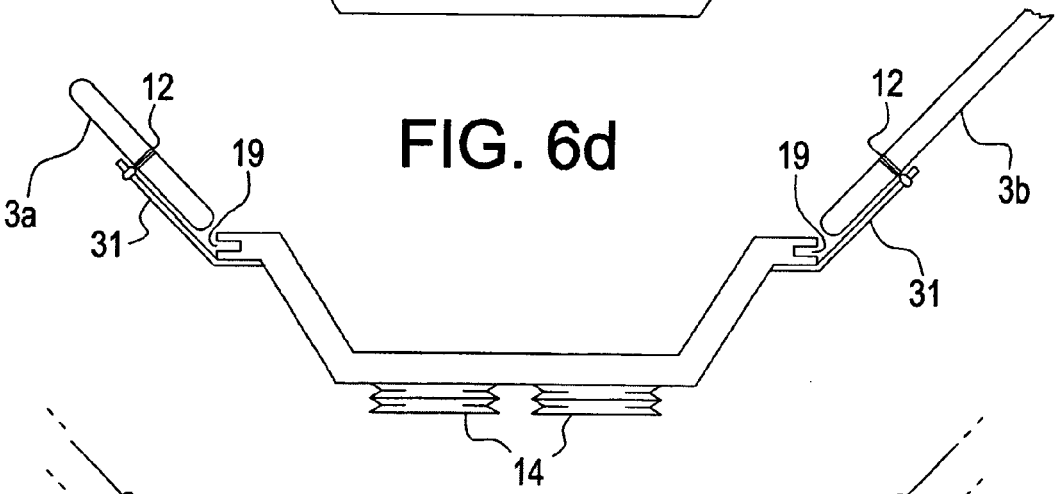

FIGS. 6*a-d* show top views of central beam variant and hardware associated with the central beam. FIG. 6*a* is the beam core of the simplest variant, essentially a long flat plate, with alignment tracks 19 at each edge. FIG. 6*b* shows beam core in the shape of a "V" designed to increase the stiffness of the BS against bending moments. FIG. 6*c* shows the preferred design, with a "high hat" shaped core used extensively in aerospace and other industries to stiffen beams, along with other hardware associated with the BS. FIG. 6*c* is the top view of the upper end of the BS shown, for example in FIG. 2*c*, including the upper beam extension pulleys 13, and attachment tabs 30 for attaching the stay cabling BSD 8 to the upper end of the BS. FIG. 6*d* is a top view of the lower end of the BS, including the lower beam extension pulleys 14, and attachment tabs 31 containing the rotary joint 12 for attaching the stays shown as 3*a* on the left side of the drawing in the folded or stowed position, and as 3*b* on the right side of the drawing in the rotated or deployed configuration.

Figure 7A:
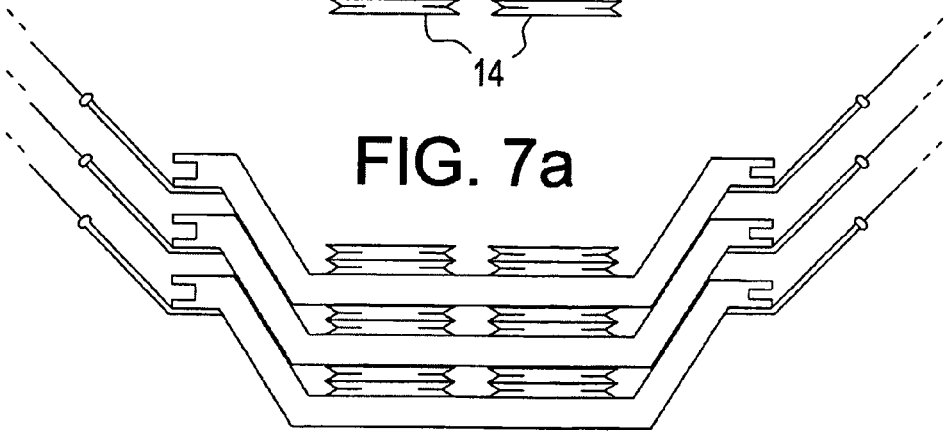
FIGS. 7*a-g* show views of nested BS and associated pulleys, cables and other hardware.
Figure 7B:
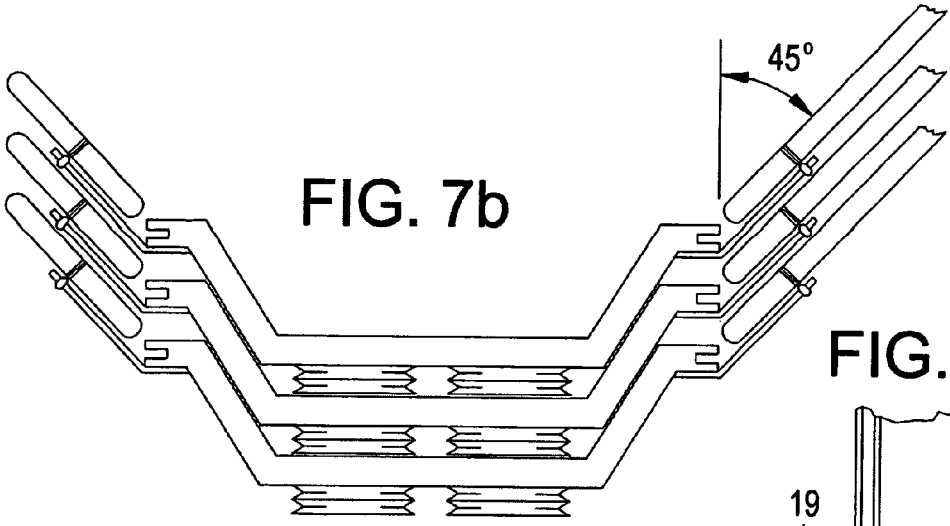

FIGS. 7*a-g* shows views of nested BS and associated pulleys, cables and other hardware. FIG. 7*a* is a top view of the upper level of the three nested beam segments similar to that shown in FIG. 6*c*. FIG. 7*b* shows the top view of the lower level of the three nested beam segments similar to that shown in FIG. 6*d*.

Figure 7C:
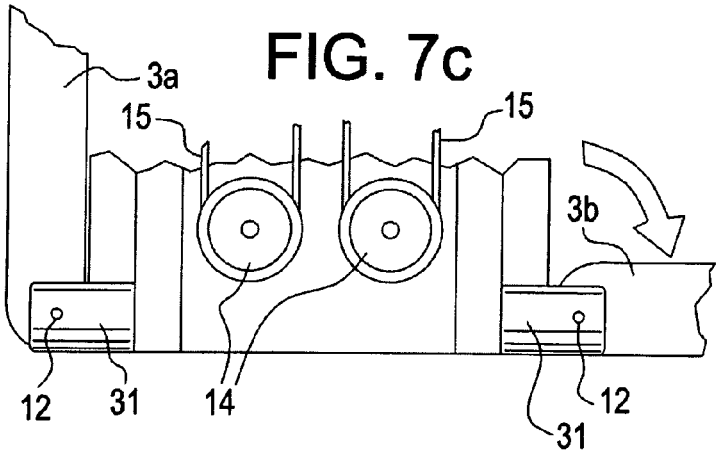

FIG. 7*c* is a frontal view of the lower beam with pulleys 14, stay attachment tabs 31, rotary joint 12 and stay 3*a* in the stowed position, and stay 3*b* in the rotated or deployed position.

Figure 7D:
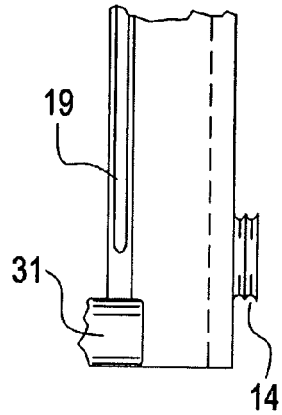

FIG. 7*d* is a side, edge view of the lower beam with pulleys 14, attachment tab 31, and alignment track 19.

Figure 7E:
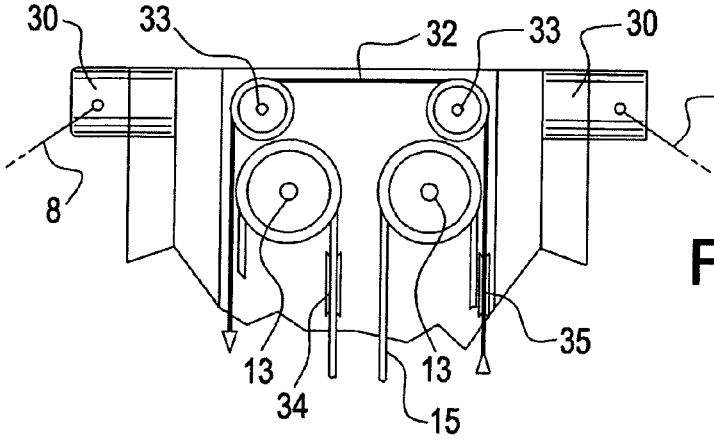

FIG. 7*e* is a frontal view of the upper beam with pulleys 13, continuous cable BEC 15, beam control cable BCC 32, pulleys 33 that rout cable BCC 32 across the top of the upper beam segment 4 reversing its direction, beam crossover point 34 where cable BEC 15 is routed across the BS to the adjacent BS, beam crossover point 35, where BCC 32 is routed across the BS to the adjacent BS, BSF 8 cable, and attachment tabs 30.

Figure 7F:
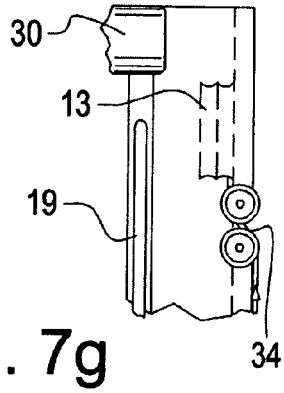

FIG. 7*f* is a side view of the upper beam with embedded pulleys 13, (in the figure hidden from view, but shown as dotted lines), attachment tab 30, and alignment track 19 and crossover point 34.

Figure 7G:
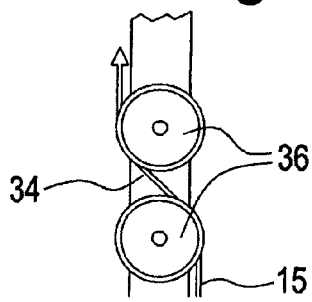

FIG. 7*g* is a magnified view of the crossover points 34 and 35, where pulleys 36 allow a low friction transition from one side of the beam segment to the other when cables 15 and 32 are under tension. This transition could be accomplished without the pulleys, but with added friction.

Figure 8A:
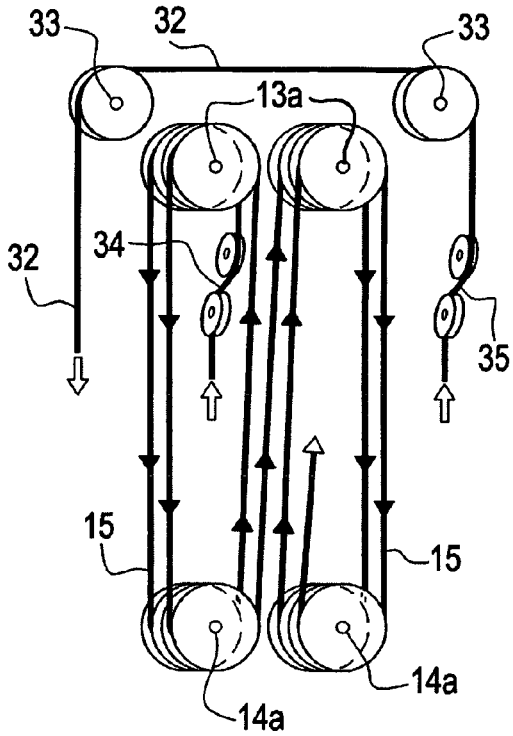
FIG. 8*a* is an exploded view of the beam extension subsystem cables and pulleys illustrated in FIG. 7.

FIG. 8*a* is an exploded view of the beam extension subsystem cables and pulleys illustrated in FIG. 7 for cable BEC 15 routed through the eight upper and lower beam extension pulleys 13*a* and 14*a*, and the crossover point 34, and cable BCC 32 routed over pulleys 33 and crossover point 35. The continuous retracting cable is thus routed through each of the sets of pulleys with multiple loops sandwiched between any two segments connected via transfer pulleys at one end of each BS to the next BS pair. For example, the cable from $BS_1$ passes through $BS_2$, to the space between $BS_2$ and $BS_3$ via crossover point 34, and in like manner, all the way to the last pair $BS_{(N-1)}$ to $BS_{(N)}$. Thus, retraction of the continuous cable exerts a beam extending force on each BS pair, extending the whole beam structure to N×the length of each beam segment, minus the length of each beam segment's pulley system (5-10% the length of each BS). For example, the total height of a tower composed of 15 ten foot segments would be 0.9×(15×10)=135 feet.

In the 8-pulley system shown in FIG. 8*a*, there are 8 strands of cable 15 between the upper and lower sets of pulleys and therefore a theoretical mechanical advantage of 8. In the EBS, however, for every 8 ft. of cable BEC contraction, there is one foot of the relative extension of one BS relative to the adjacent BS, thus extending cable 15 upward by one foot. The mechanical advantage of the system is therefore 7 instead of 8, which is nonetheless adequate for most system deployments.

The importance of mechanical advantage between each BS is important for two reasons. With relatively stout central beam segment system, the EBS can lift heavy payloads with smaller diameter cabling, which is required for pulleys with modest diameters. Furthermore, a large force is required to overcome friction in other pulley systems required to play out the vertical cables at the tips of the stays during EBS extension as described.

Figure 8B:
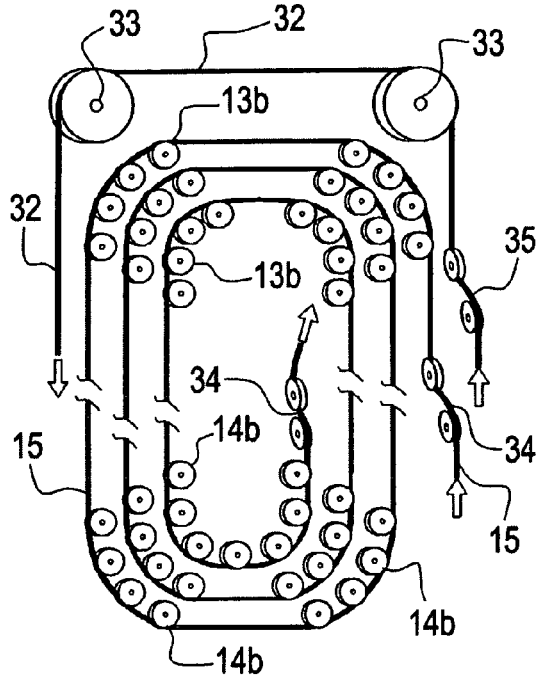
FIG. 8*b* shows a less conventional pulley system, but one that allows a high mechanical advantage with all of the cabling in one plane routed over multiple micro-pulleys.

FIG. 8*b* shows a less conventional pulley system, but one that allows a high mechanical advantage with all of the cabling in one plane routed over multiple micro-pulleys 13*b* and 14*b*, with different radius of curvature so that turns of the cable with smaller radius of curvature can be nested within curvatures with a greater radius. The advantage of this variant pulley system is as follows. For applications where there are many beam segments, it is advantageous to minimize the space between each beam segment so that the out-of-plane thickness of the beam segment package itself is not too great.

In order to increase mechanical advantage in the system shown in FIG. 8*a*, additional layers of pulleys must be added in the out of plane direction, which adds to the thickness of the pre deployment beam segment package. Furthermore, adding pulleys to the same axle in the out-of-plane direction adds to the strain on the axles holding the pulleys. The distributed micro-pulley arrangement in FIG. 8*b* distributes the heavy loads involved in EBS deployment onto many more pulley axles, thus distributing the load. The FIG. 8*b* variant allows for larger radius of curvature to the pulley system so that thicker cables can be used to increase the extending force of the EBS.

Beam Segment Extension Control Subsystem

Figure 9:
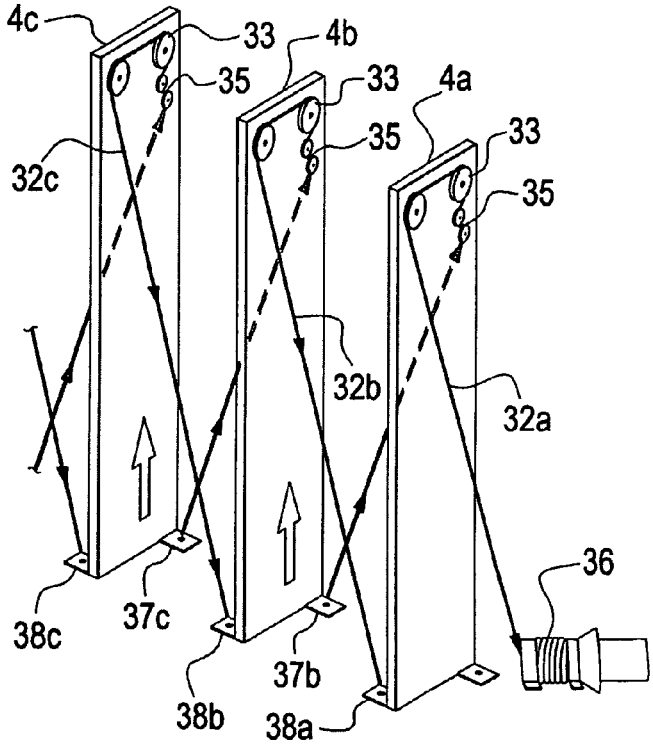
FIG. 9 is a schematic representation of the beam control cable BCC system for maintaining equal BS spacing during ascent and descent.

FIGS. 8*a* and 8*b* show the beam control cable BCC 32 routed through crossover point 35 and across pulleys 33, descending toward the lower end of the BS. FIG. 9 shows how BCC controls the simultaneous extension of beam segments BS so that there is equal spacing among the BS levels as the EBS is extended. In FIG. 9, winch 36 retracts cable 32*a* which is routed over pulleys 33 at the upper end of BS 4*a*, shown here as being stationary, as would be the case of the BS at the base of the EBS, with cable BCC 15 passing through BS 4*a* at crossover point 35 and attaching to BS 4*b* at attachment point 37*b* on BS 4*b*. In like manner fixed length cable BCC 32*b* is attached to BS 4*a* at attachment point 38*a* and is routed through upper pulleys 33, through crossover point 35 to attachment point 37*c* on BS 4*c*.

As can be seen from the drawing, the retraction of cable 32*a* by winch 36 with BS 4*a* being stationary elevates BS 4*b* by the amount of cable length retracted by winch 36. The movement upward of BS 4*b* in turn retracts fixed length cable 32*b*, which is anchored at point 38*a*, such that BS 4*c* is elevated by a like amount by the retraction of cable 32*b* attached to BS 4*c* at point 37*c*. All BS are in turn elevated by this mechanical linkage, each over adjacent BS by an amount equal to the length retracted by the winch 36.

Thus each BS is raised simultaneously and equally by the action of winch 36. Thus any movement by one of the beam segments will cause or be caused by the retraction of the first length of cable 32 by winch 36. Furthermore, during elevation, Beam Retraction Cable BRC 25 attached to the payload at the topmost BS is played out by winch 24 in length equal to the length of elevation of the EBS during any portion of the upward deployment. These two cable systems thus guarantee that the beam segments will be deployed in a simultaneous but controlled manner such that there is equal distance between each level as it ascends and descends The action of winch 36 connected to and operates in conjunction with winch 16 in FIG. 3*a*, but is sized in such a way that the amount of cable retracted by 36 is a fraction of that retracted by 16 but is in proportion to the length of cable required to maintain BS separation control. Furthermore, during elevation, the amount of cable played out by winch 24 controls the length of the sum of BS segments extended such that the actions of winch 36 and 16 which are combined forces of extension, are checked by a force of retraction which is exercised by winch 24 playing out Beam Retraction Cable BRC 25 the length of which at any point in the deployment process is equal to $N \times l_2$. When the EBS as a total system is retracted, all of these cable subsystems are reversed such that the BRC 25 is retracted by winch 24 and cables 5 and 15 are played out by winches 36 and 16 in direct proportion to lengths required to maintain a stable EBS during the contraction process.

Citing, for example, the 135 foot tower described above, with 15 ten foot segments at full extension would entail 9 ft. of cable BCC 32 retracted on winch 36, but 15×9 ft.×7=1305 ft. of cable BES 15 retracted on winch 16, where 15 is the number of BS segments, 9 ft. is the amount of elevation of each BS, and 7 is the mechanical advantage of the upper and lower pulley systems 13 and 14, as described previously. Furthermore, the Beam Retraction Cable would be played out 9 ft.×15 or 135 ft. at full EBS extension, but in an amount during deployment, which is proportional to the length required to maintain a restraining force on the whole deployment.

Control of EBS Deployment, Cable Play Out/Retraction Subsystem

Simultaneous and equal extension of the beam segments can be controlled through the simultaneous and integrated play out and retraction of the various cables by the winch subsystem, whether through a mechanically linked integrated winch subsystem described in subsequent paragraphs and a figure or a distributed electronically controlled set of winches. The winch system must simultaneously control the extension and retraction of four cable subsystems: Beam Extension Cable_(BEC) 15, the Beam Retraction Cable (BRC) 25; the Beam Control Cable (BCC) 32: and the External Anchoring Cables (EAC) 6 which is optional for certain applications. This could not be done efficiently and successfully if the beam segments were deployed randomly. Likewise a beam extension strategy described previously where the top most BS is deployed fully, with all other segments locked down, then the next segment deployed fully and so on until the last segment is deployed, though theoretically possible, would be unnecessarily complex, with locking and release systems required, along with a very complex winching system.

The rationale for maintaining control by means of the three essential the Beam Control Subsystem cables and their winches is as follows. The Beam Extension Cable 32 is continuous through all beam segments. If the multiple beam segments were "free floating" that is not controlled by other means, then the contracting force between each BS pair could differ slightly due to frictional losses in the multiple pulley systems, with the upper BS experiencing less friction due to their location. Thus the extension of the EBS would be somewhat haphazard, with some BS pairs experiencing more extension than others.

With the multiple BCC cables in place, the EBS deployment is under control as follows. When the bottom BS pair experiences the force of extension due to the retraction of the BEC 15 cable, the next pair will encounter not only the extension force due to BEC 15, but also the extending force of the BCC 32 cable subsystem, which however, allows only as much extension as is allowed by the length of cable retracted on winch 36. In fact, the BS pair is restrained not to extend further by the BCC 32 cable subsystem. Since all BS pairs are mechanically connected in like manner, this has the effect of controlling the extension of the whole EBS system simultaneous and with equal spacing among the multiple BS pairs. Finally, the total length of the EBS is controlled by the Beam Retraction Cable BRC 25, which limits the upward forces of both extension cable subsystems 15 and 32.

Note, there are different but fixed mechanical advantages in the three cabling systems that exercise control. In the example cited above, the length of cable 15 retracted by winch 16 to fully extend the EBS is 1305 ft. Winch 24 plays out 135 ft. of cable 25 and winch 36 retracts 9 ft. of cable 32. The ratio of the lengths of these three cable either played out or retracted during deployment is 9:135:1305 or 1:15:105. As long as the three winches are configured through winch spool diameters or reduction gears to maintain these ratios, the deployment will be controlled with cable lengths retracted or played out appropriately to maintain the EBS stability.

One can see from the above discussion why the extension subsystem represented by cable 15, pulleys 13, and 14, and winch 16 is the principal force for extending the EBS, and why the EBS can lift very heavy objects. In the case of the 135 ft. tower, if cable 32 was made of ⅛ inch multi-stranded stainless steel wire rope, with a breaking strength 2000 lbs, the maximum force generated between a pair of BS segments given the eight strands of rope in the compound 8 pulley system between each BS pair as illustrated in FIG. 8, would theoretically be over 16,000 pounds with a modest sized winch capable of retracting cable with a force of 2,000 pounds and each BS stout enough to handle the 16,000 pounds of compressive force.

With a liberal safety margin, the EBS would be capable of lifting thousands of pounds of payload, in addition to the weight of the EBS system itself, and the necessary force to overcome the substantial friction involved in operation of the other cabling systems like the extension of the vertical cable 5 with its multiple pulleys 27*a* and 27*b* and the BCC cables 32 through pulleys 33 and crossover points 34 and 35.

Avoiding Stay/Cable Interference (Four Stay, Dual Central Beam Variant)

One of the key features of the EBS concept is the ability of the rather complex network of stabilizing external cables 5, 8, 10, and 11 to be able to support the EBS extension with out interfering with each other. This is accomplished by design of the cable attachment points at the ends of each stay, and the lengths of the stays themselves allowing clearance for adjacent cables to clear the stay during the deployment process.

Figure 10:
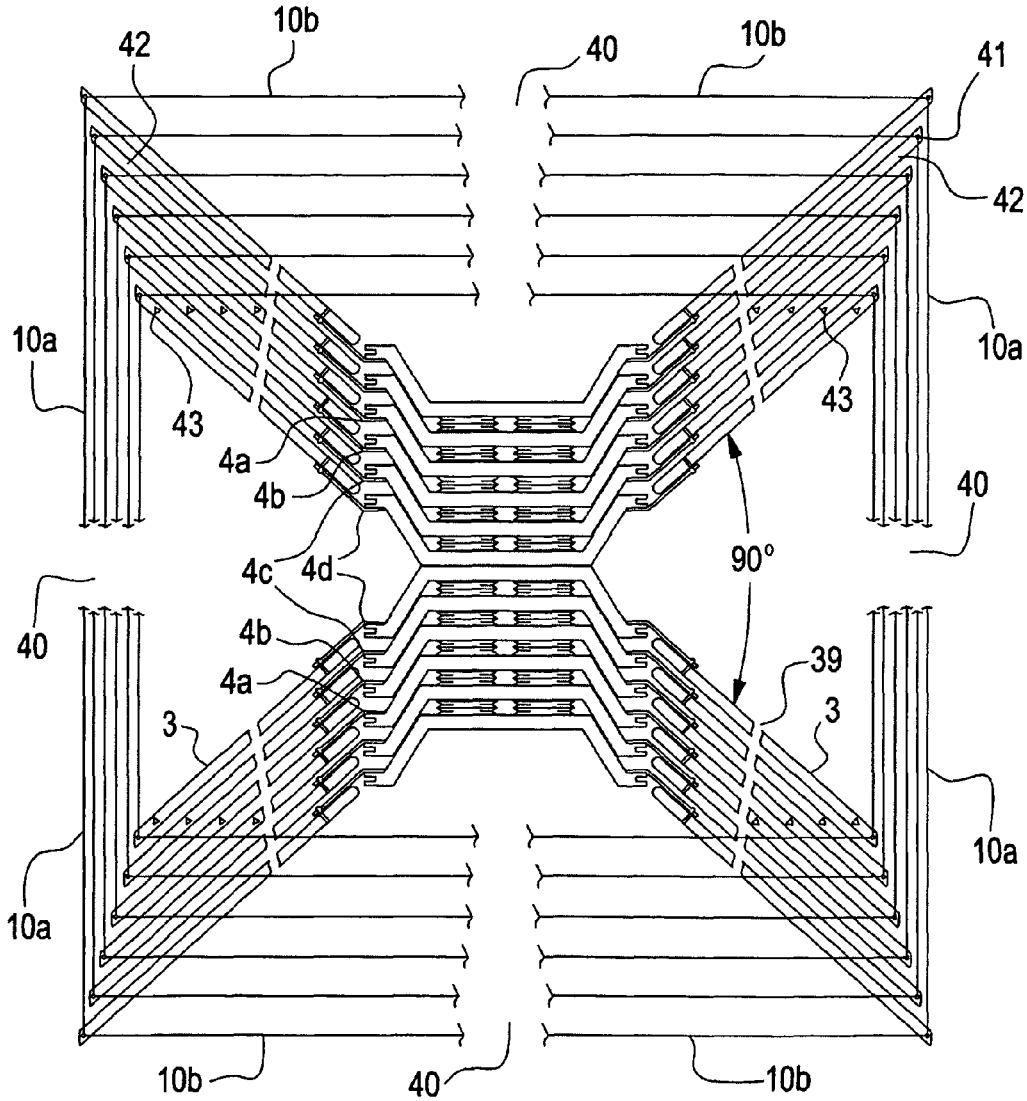
FIG. 10 is the top view of a four-stay EBS system, with a dual central beam structure similar to that shown in FIG. 4 with stay tip lengths aligned to avoid cable interference during ascent and descent.

FIG. 10 is the top view of a four-stay EBS system, with a dual central beam structure similar to that shown in the FIG. 4, with multiple beam segments BS nested in the dual central beam structure, with each BS attached to 2 stays as shown in FIG. 6*d*. This dual central beam approach with 2 stays per BS results in a 4 stay per level system, shown for example in a more simplified version in FIG. 2*a*. The figure, as a top view, shows four sets of multiple nested stays SS 3 which have been already rotated into position for deployment with the tips of each of the stays attached to multiple fixed in-plane stay to stay cabling referred to previously as SSFi 10.

Note, the figure is not to scale in the sense that the length of the stays relative to the dual central beam structure in the center are much longer than indicated, as are the stay tip cables 10 in the horizontal plane. Thus in this top view there are break points indicated by wavy lines in the nested stays 3 at point 39 and the multiple stay to stay cables 10 at point 40. This allows for a more magnified view of the stay tips showing how the stays can be deployed without stay/cable interference. Cables 10*a* are shown attached to the multiple stays the tips 41 which are slightly offset so that no cable overlaps any of the stays. Cables 10*b* on the other hand do in fact overlap the stays at 42 as shown in the top view of FIG. 10, but do not block adjacent stays during deployment as can be seen in the following discussion.

FIG. 4 shows the deployment of the dual central beam from a side view with the innermost pair of beam segments 4*d* elevating away from the second pair 4*c*, the second away from the third 4*b* and the third away from the fourth 4*a*. It will now be seen from the top view FIG. 10 that the simultaneous elevation of the various beam segments (out of the page from the perspective of the top view) from innermost to outermost, 4*d* through 4*a* is done in such a fashion that no cable 10*b* will block the elevation of the adjacent beam segments.

It is to be noted also that attachment points for the beam to stay fixed cables BSF 8 shown as small triangles at 43 are all positioned inboard from the innermost SSFi 10*a* and therefore will not interfere with cables 10 during deployment.

Avoiding Stay/Cable Interference (Three Stay, Single Central Beam Variant)

Figure 11A:
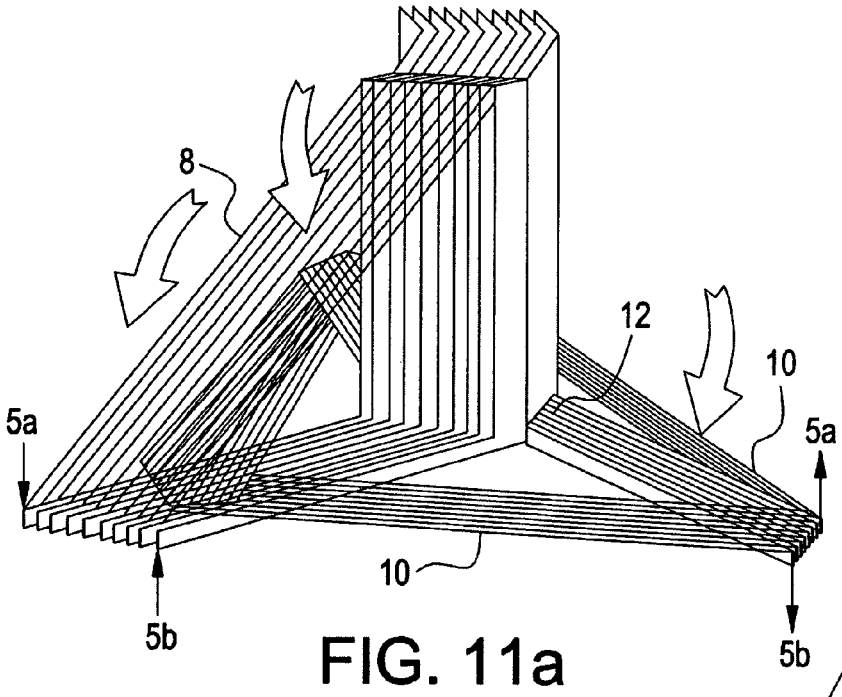
FIG. 11*a* shows how three stays per level can be affixed to a single set of nested beam segments shown previously in FIG. 2*c*, but now with a third set of nested stays.

FIG. 11*a* shows how three stays per level can be affixed to a single set of nested beam segments shown previously in FIG. 2*c*, but now with a third set of nested stays shown in perspective view FIG. 11*a* as rotating down ward in a clockwise CW direction from the central beam package around rotatable joints 12. The rotatable joints are connected to lower beam segment extensions, hidden in this view, but illustrated in later figures. Also shown are leading and trailing cables 5*a* and 5*b*, diagonal fixed length cables BSF 8 and in plane fixed length cables SSFi 10.

Figure 11B:
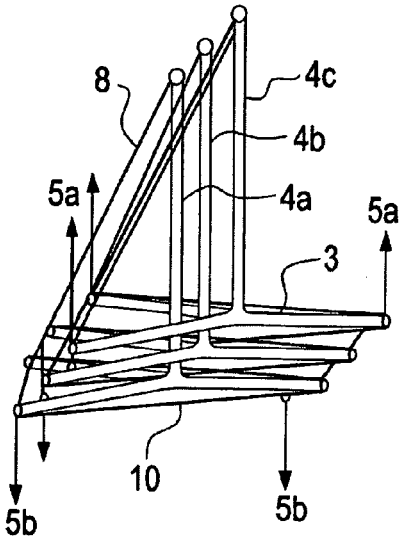
FIGS. 11*b* and 11*c* show with stick models how deployment of the three stay variant occurs without interference of cables and stays.
Figure 11C:
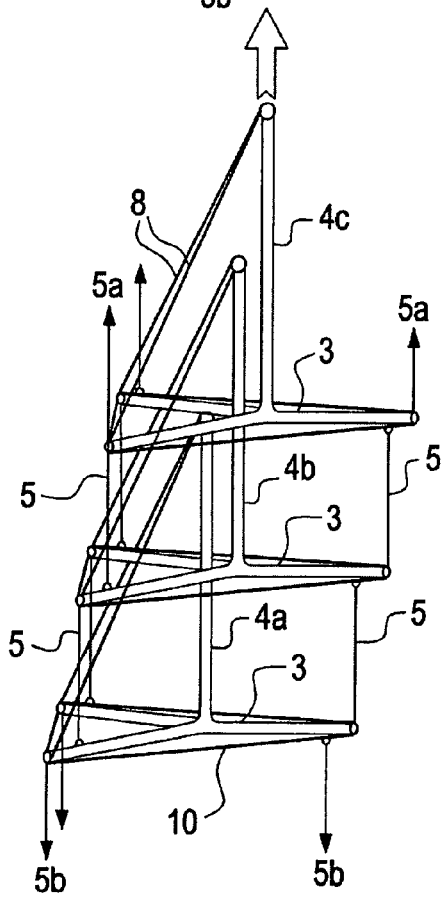

FIGS. 11*b* and 11*c* show stick models of the 3-stay variant in the pre-deployment state, FIG. 11*b*, then in deployment phase with beam segments extending upward in FIG. 11*c*. FIG. 11*c* shows leading and trailing vertical cables 5*a* and 5*b*, in tension, providing the necessary forces to extend cables 5 as beam segments 4*a*, 4*b*, and 4*c* slide past each other with cables 5 played out through the mechanism shown in FIG. 5 The stick models illustrate how beams and stays can be nested in such a way that extension of the beam segments and stays can be done without interferences of cables 5, 8 and 10.

Figure 12A:
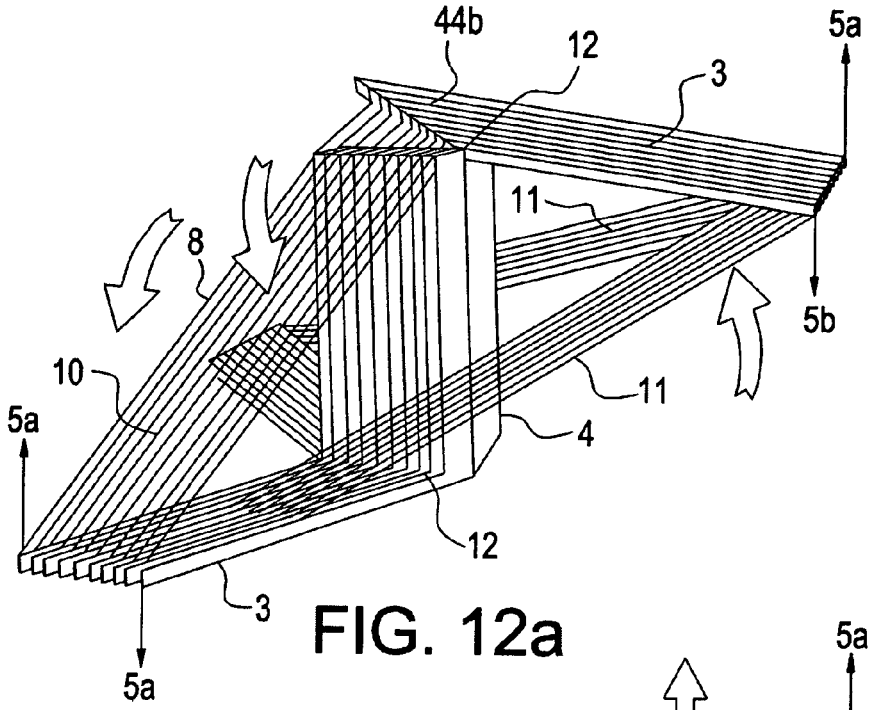
FIG. 12*a* shows an alternative three-stay variant with one set of nested stays attached to the top of the nested beam segments.

FIG. 12*a* shows an alternative three-stay variant where two sets of nested stays 3 on the left hand side are attached through rotatable joints 12 to the lower end the stowed beam segments 4, with one set of stays 3 on the right side connected to the upper level through beam segment extensions 44 *b* and deployed upward through rotatable joints 12. Also shown are leading and trailing cables 5*a* and 5*b*, with two sets of diagonal fixed length cables BSF 8 connecting the two sets of stays on the left side, with one set of in plane horizontal fixed length cables SSFi 10 connecting the tips of the two sets of stays on the left hand side. On the right hand side, two sets of out-of-plane diagonal fixed length cables SSFo 11 connect the single set of upper stays on the right, to the two sets of stays on the left.

Figure 12B:
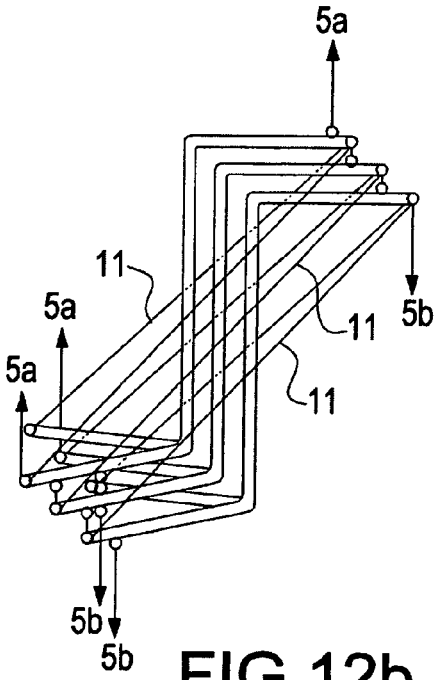
FIGS. 12*b* and 12*c* show stick models of the three-stay variant in the pre-deployment state and the deployed state illustrating again non interference of cables and stays.
Figure 12C:
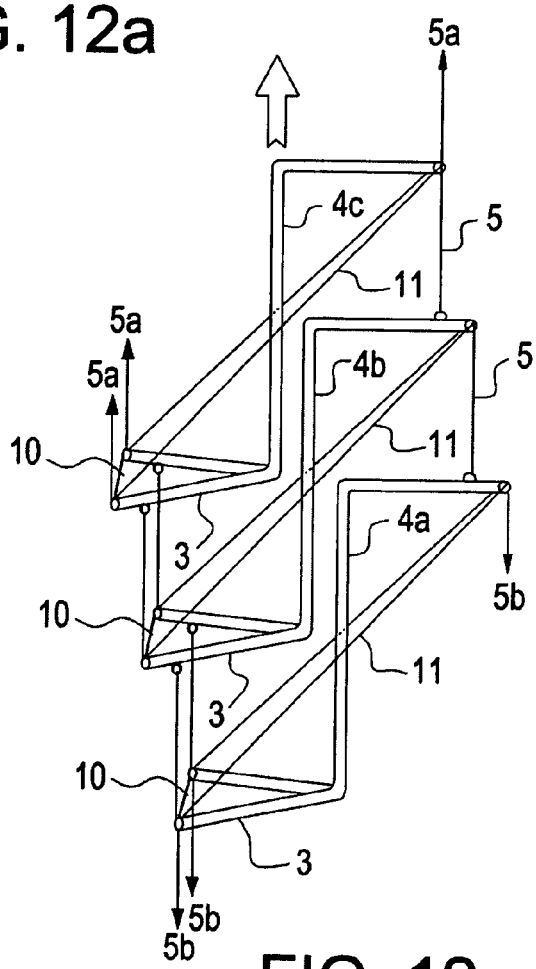

FIGS. 12*b* and 12*c* show stick models of the three-stay variant in the pre-deployment state, FIG. 12*b*, then in deployment phase with beam segments extending upward in FIG. 12*c*. As with FIG. 11*c*, FIG. 12*c* also shows leading and trailing vertical cables 5*a* and 5*b*, in tension, providing the necessary forces to extend cables 5 as beam segments 4*a*, 4*b*, and 4*c* slide past each other with cables 5 played out through the mechanism shown in FIG. 5 As with FIGS. 11*a*, 11*b*, 11*c*, the stick models illustrate how beams and stays can be nested in such a way that extension of the beam segments and stays can be done without interferences of cables 5, 8 and 10.

Figure 13:
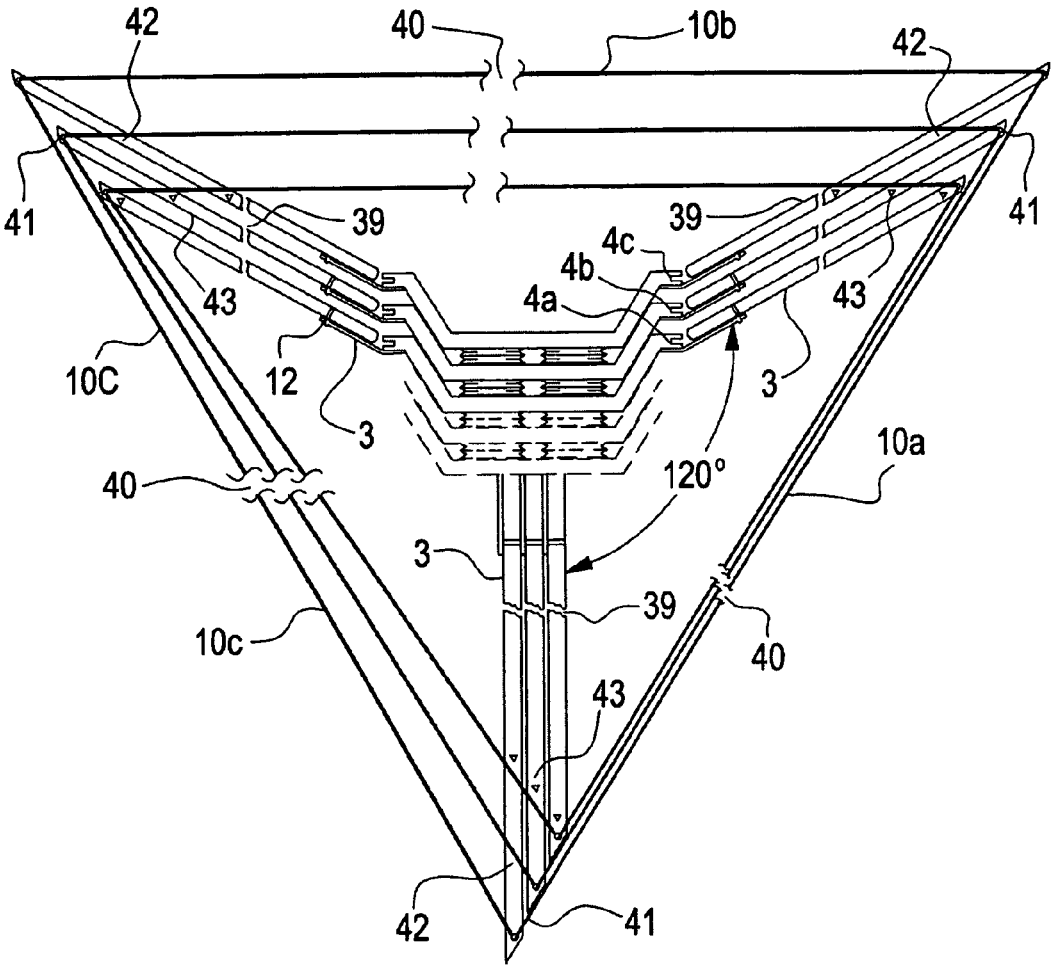
FIG. 13 is the top view of a three-stay EBS system, similar to the four-stay top view in FIG. 10, but with a single central beam with each BS attached directly to two stays, (with the third set attachment points hidden), illustrating again stay tips aligned properly to avoid interference.

FIG. 13 is the top view of a three-stay EBS system, as illustrated in previous FIGS. 11 and 12, similar to the four-stay top view in FIG. 10, but with a single central beam with each BS attached directly to two stays as shown in FIG. 6*d* and the third stay attached via the beam segment extensions shown in FIG. 11.

Note, as with FIG. 10, FIG. 13 is not to scale in the sense that the length of the stays relative to the central beam structure are much longer than indicated, as are the stay tip cables 10 in the horizontal plane with break points indicated by wavy lines in the nested stays 3 at point 39 and the multiple stay to stay cables 10 at point 40. This allows for a more magnified view of the stay tips showing how the stays can be deployed without stay/cable interference.

Cables 10*a* are shown attached to the multiple stays the tips 41 which are slightly offset so that no cable overlaps any of the stays. Cables 10*b* on the other hand do in fact overlap the stays at 42. Cables 10 *c* do not overlap stays in the upper left hand portion of the FIG. 13 at 41, but do in the lower portion of the figure at 42. But, none of the overlapping cables block the upward deployment of the EBS in a manner similar to that described for FIG. 10 where the simultaneous elevation of the various beam segments (out of the page from the perspective of the top view) from 4*a* through 4*c* is done in such a fashion that no cable 10*b* or 10*c* will block the elevation of the adjacent beam segments.

As in FIG. 10, that attachment points for the beam to stay fixed length cables BSF 8 shown as small triangles at 43 are all positioned inboard from the innermost cables 10, and therefore will not interfere with cables 10 during deployment.

Avoiding Stay/Cable Interference (Four Stay, Single Central Beam Variant)

Figure 14B:
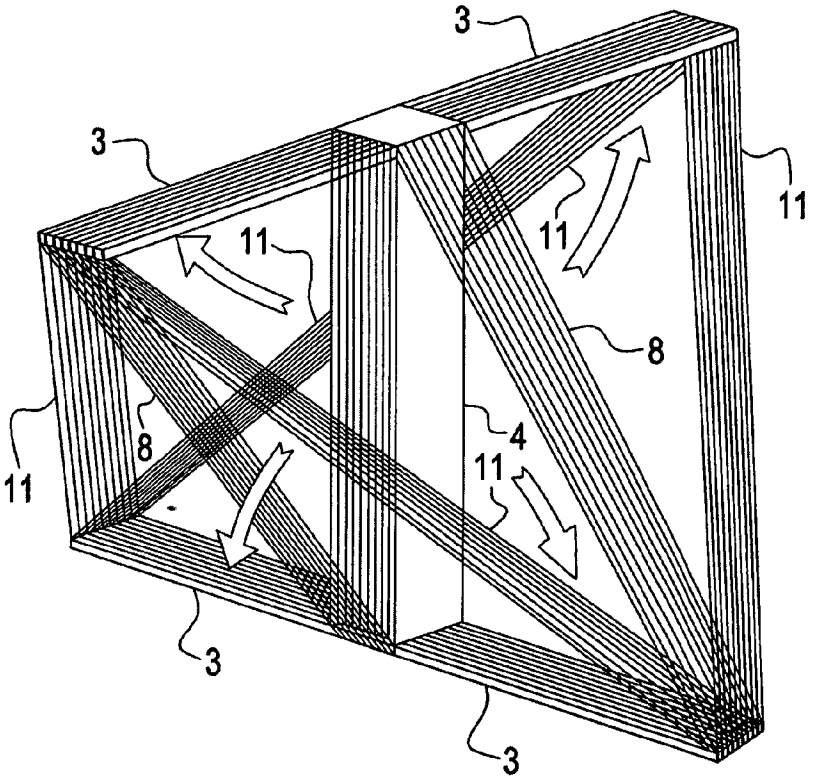
FIGS. 14*a* and 14*b* show how four stays per beam segment in a single central beam can be supported with stabilizing cables, without the cables interfering with the stays.
Figure 14A:
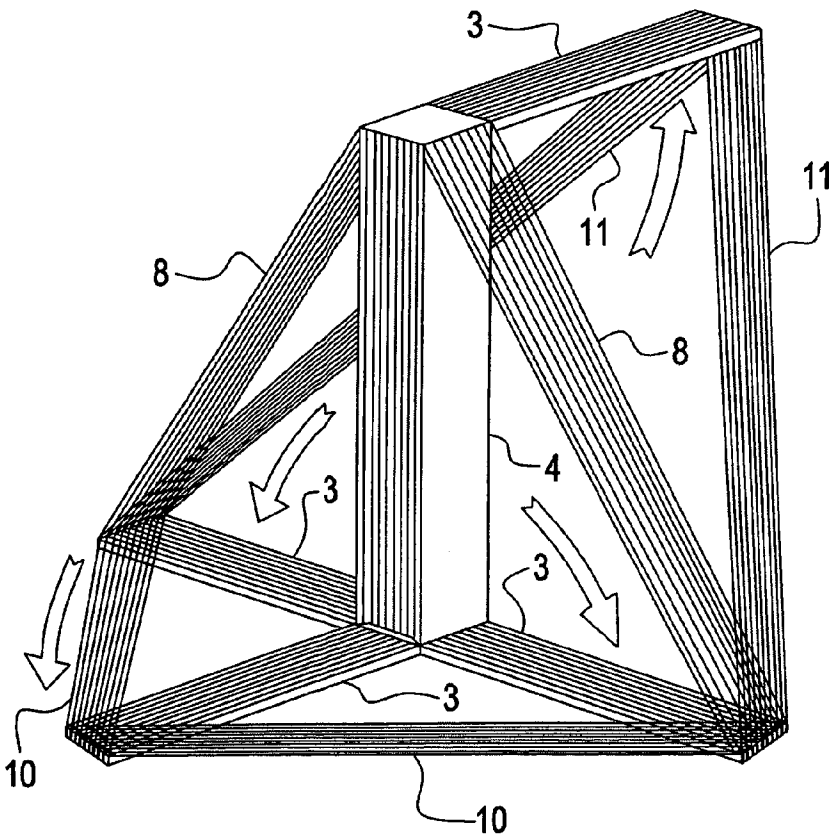

FIGS. 14*a* and 14*b* show how four stays per beam segment in a single central beam can be supported with stabilizing cables, without the cables interfering with the stays as the EBS is extended, using the same principles illustrated in previous figures (FIG. 11, FIG. 12, and FIG. 13) as discussed previously.

In FIG. 14*a*, three nested stay packages 3 are rotated downward from the nested beam segments 4 into the same lower plane, with two sets of fixed length in-plane cables SSFi 10 linking their stay tips, two diagonal sets of cables BSF 8 linking stay tips to central beam segments, and two sets of out-of-plane fixed length cables SSFo 11 linking the tips of two of the sets of the stays SS3 in the lower horizontal plane with one set of stay tips SS3 joined to the upper end of the beam package, rotated upward during the pre-deployment phase.

FIG. 14*b* shows a variant where two sets of nested stays SS3, joined to the upper end of the nested beam segments 4 are rotated upward during pre-deployment, and two sets joined to the lower end rotated downward. Here there are no horizontal in-plane cables 10, but rather four sets of out-of-plane stay tip cables SSFo 11, and two sets of diagonal beam to stay cables BSF10.

Generalized Model Showing Stay and Fixed Cable Attachment Points

Figure 15E:
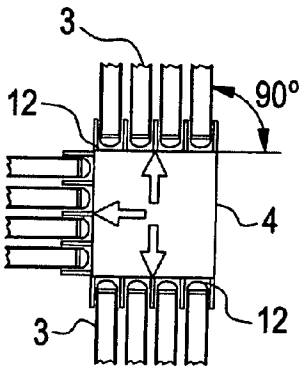
FIGS. 15*a-h* show it is possible to general from the previous examples that there are a number of possible stay configurations with a single central beam.
Figure 15D:
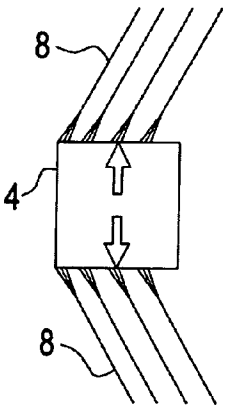
Figure 15C:
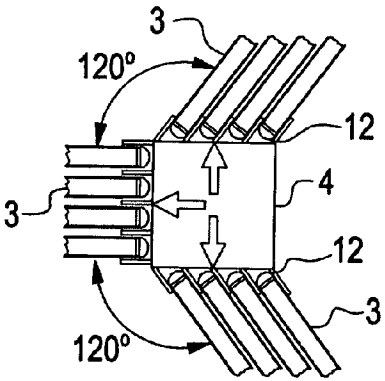
Figure 15B:
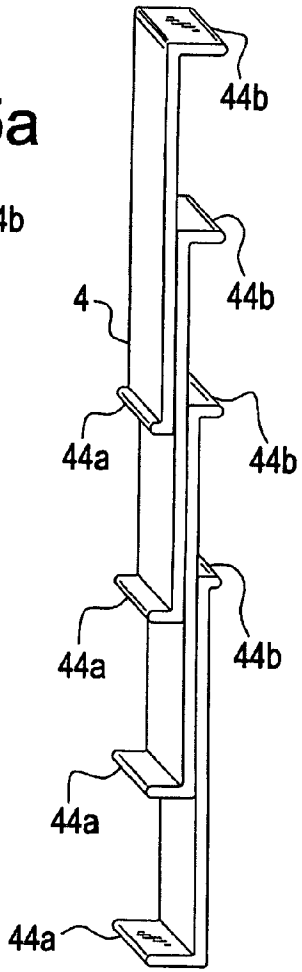
Figure 15A:
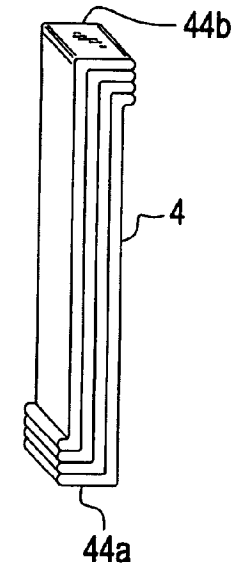
Figure 15H:
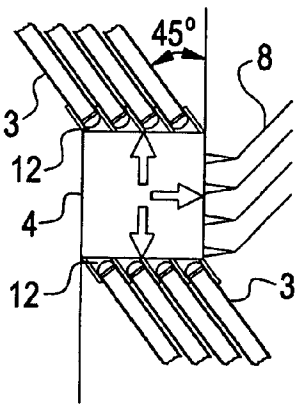
Figure 15G:
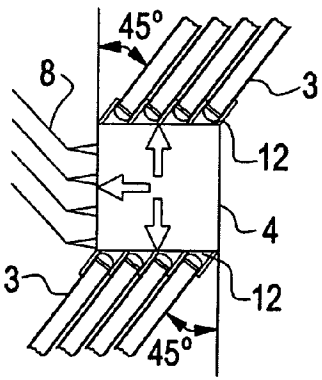
Figure 15F:
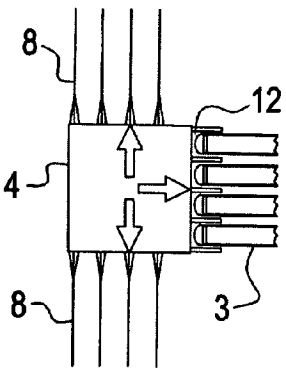

FIGS. 15*a-h* show it is possible to generalize from the previous examples that there are a number of possible stay configurations with a single central beam 4 using the orthogonal beam extensions or platforms at the ends of the each of the beam segments 4. A platform is any fixed orthogonal extension of the BS, top and bottom, that allows attachment points on three sides for stays or cable attachment tabs. These are shown as 44*a* and 44*b* in stylized (not to scale) drawing FIG. 15*a* as nested structures at the ends of the beam segments. As the central beam 4 is extended, these platforms 44*a* and 44*b* provide numerous attachment points for stays 3 and fixed length cables 8 as shown by the arrows at each of the platform levels. FIGS. 15*c*, 15*e*, and 15*g* show a composite top view of the lower platforms 44*a* with stays 3 and cables 8 attachment points allowable on three sides of the central beam 4 (top, bottom, and left side in the drawings). FIGS. 15*d*, 15*f*, and 15*h* show a composite top view of the upper platforms 44*b*, which is in effect the mirror image of 44*a*, with stays 3 and cables 8 attachment points allowable on three sides of the central beam 4 (top, bottom, and right side in the drawings). The drawings in FIGS. 15*c* through *h* represent generalized configurations previously described in the 3-stay and 4-stay, single central beam variants.

FIGS. 15*c* and 14*d* show the top level composite views of the upper and lower level platform associated with the 3 stay variant in FIG. 11, as described above. The lower level platforms 44*a* shown in FIG. 11*c* with three sets of stays attached through rotary joints with attachment tabs 31 angled such that the stays 3 are 120 degrees apart. FIG. 15*d* shows the top view of the upper platforms 44*b* with angled attachment points for diagonal cables BSF 8 running from the upper beam platforms to the angled stay tips in FIG. 15*c*.

Likewise, FIGS. 15*e* and 15*f* represent the upper and lower attachment point associated with FIG. 14*a* where stay attachment tabs are orthogonal to the central beam, with three sets of rotatable joints 12 on the lower level 44*a*, one set on the upper level 44*b*, with two sets of BSF 8 attachment points on the upper level platforms 44*b*.

FIG. 15*g* represents the upper and lower levels of FIG. 14*b* where stay attachment tabs 31 are at 45 degree angles relative to the central beam, two sets of SS3 on the lower level 44*a*, and two sets on the upper level 44*b*. There are two sets of BSF 8 attachment points on the upper level. All of the other sets of cables associated with this configuration are out-of-plane cables SSFo 11.

In general, a number of other stay cable combinations are possible but not shown, which essentially adhere however to the principles articulated in these single central beam examples, namely, as long as three sides of the upper and lower extensions 44*a* and 44*b*, mirror images of each other, are utilized for stay attachment tabs 31 or BSF 8 attachment points, no matter the angle of tab attachment to the central beam within certain limits (e.g., normal to central beam, up to 30 or 45 degrees off normal), an architecture can be devised along with in-plane and out-of-plane stay tip to stay tip cables SSFi and SSFo to stabilize any combination of stays and cables without interference of stays and cables as the EBS is extended.

Cable Play Out and Retraction Winches and Tensioning Mechanisms

An essential feature and primary requirement of the EBS is the capability of winches to play out and retract cables precisely and in a controlled manner to maintain adequate structural stiffness during the extension process. Otherwise, bending or buckling could occur, especially in those cases like PT where heavy payloads must be elevated in wind loading environments. This is controlled play out and retraction of cables is accomplished through Motorized Winch(es) and Tensioning Mechanisms, usually in the base of the EBS that plays out and retracts the four cabling systems subject to change during the deployment process. This includes: the Anchoring Cables (AC); the Beam Retraction Cable (BRC); the continuous Beam Extension Cable (BEC); and the Beam Control Cable (BCC). All four cabling systems must be synchronized in terms of the lengths of cable played out and/or retracted. This can be done mechanically with a centrally located winch subsystem as will be described, or with a distributed winch system relying on centralized computer control described.

Centralized, Mechanically Integrated Winch Subsystem

Figure 16:
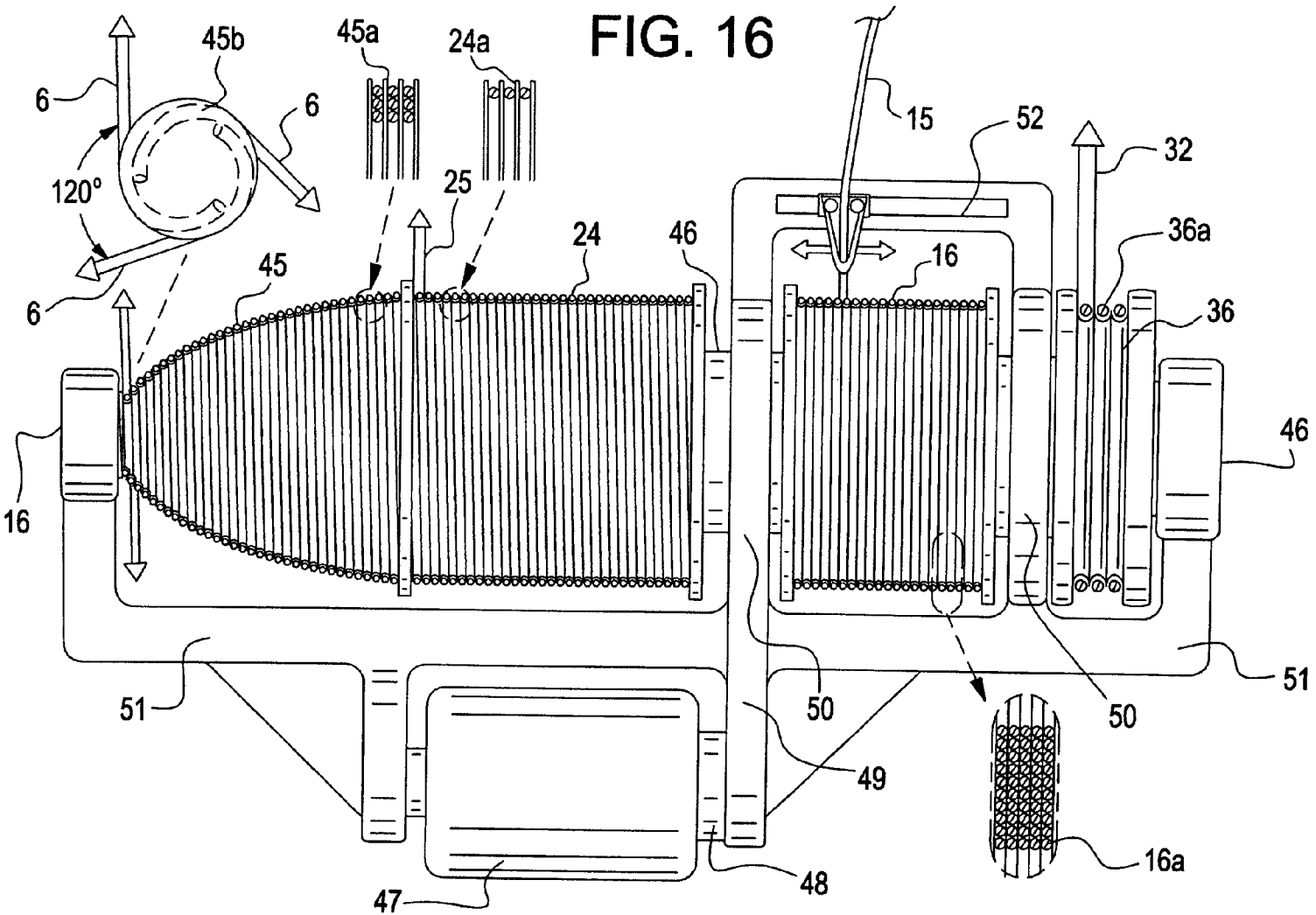
FIG. 16 shows a rather complex, but nonetheless, integrated cable play out and retraction subsystem.

FIG. 16 shows a rather complex, but nonetheless, integrated cable play out and retraction subsystem, where one motor can control all of the four winches with reduction gears coordinated to the radius of each winch, which in turn controls the amount of cable played out or retracted during EBS deployment, compensating for the differences in the lengths of cable and the mechanical advantages inherent in each cabling system. During the extension process cables can be loosened slightly through tensioning systems, described in the next section, to reduce friction, and then tightened at the end of the extension process to increase stiffness. Although each winch could be controlled separately and distributed at different locations in the EBS, as described in the next section, the most efficient and perhaps reliable, and thus least costly option may be the mechanically integrated subsystem show in FIG. 16, where winch operation is controlled by common drive shafts and reduction gears, with a single reversible motor to power the EBS extension and contraction.

FIG. 16 shows the four cable winches starting from the left: the Anchoring Cable Winch_(AC) 45 plays out or retracts cable 6; the Beam Retraction Cable Winch (BRC) 24 plays out or retracts cable 25; the continuous Beam Extension Cable Winch_(BEC) 16 plays out or retracts cable 15; and the Beam Control Cable Winch (BCC) 36 plays out or retracts cable 32. As shown in the figure, all winches are located along a common axis, with a common axle (hidden) with bearings 46 at appropriate locations to sustain heavy loads. The winches turn at different rates, and play out or retract different lengths of cable.

There are several ways that a single motor 47 can control the direction and rate of rotation of the winches, which are required to vary depending on their function and the required mechanical advantage. In one scheme, reversible motor 47 is linked through reduction gears 48 to the common axle through a power train 49 (direct drive of chain drive) embedded in the support structure. The winches rate of rotation is controlled through by means of planetary or other gearing systems embedded around the axle at 50. Or, alternatively, the reversible motor 47 could power a common drive shaft parallel to the axle, embedded in support structure 51, with appropriate gearing within 50 to power the winches at different rates.

What is essential here is that the winches rotate in a coordinated fashion, to extend or contract the EBS with the proper amount of cable dispensed from each winch. The single motor is able to power the multiple winches to extend the EBS or by reversing, power the contraction. The varying amounts of cable played out or retracted by each of the winches is proportional to the height of the tower, length and number of beam segments, and the mechanical advantage of the Beam Extension Subsystem pulleys at each end of the beam segments.

In the examples cited previously, there are varied but fixed mechanical advantages in the three cabling systems that exercise control over EBS extension and retraction. In the previous example of a 135 ft. tower, the length of cable 15 retracted by winch 16 to fully extend the EBS is 1305 ft., while simultaneously, winch 24 plays out 135 ft. of cable 25 and winch 36 retracts 9 ft. of cable 32. The ratio of the lengths of these three cable either played out or retracted during deployment is 9:135:1305 or 1:15:105. As long as the three winches are configured through winch spool diameters or reduction gears to maintain these ratios, the deployment will be controlled with cable lengths retracted or played out appropriately to maintain the EBS stability.

In FIG. 16, for example, in the 135 ft. EBS full extension, winch 36 retracts 9 ft. of cable, which is shown in the figure as approximately three turns of an 11-12 inch diameter drum where the drum retracts 3 ft. of cable 32 per revolution. Winch 16 next to it, must retract much more cable, 1305 ft, and does so with a design similar to a deep sea fishing reel where multiple layers of cable (9 layers of cable are shown in the insert 16*a*) are laid down sequentially and with precision by a mechanical guide 52, traveling back and forth across the face of the spool as the winch 16 retracts cable 15. In order to retract 1305 ft. of ⅛" cable on an 12 inch diameter drum, the face of the spool would have to be approximately 7 inches wide, with cable wrapped nine layers deep (approximately 1"), with 475 rotations of the drum to accomplish the task versus 3 rotations for winch 36.

The next drum to the left, the Beam Retraction Cable Winch 24 must play out 135 ft. of cable 25 shown in insert 24*a* as one layer deep. At 3 ft. of play out per revolution of the drum, with cable one layer deep as shown in insert 24*a*, drum would undergo 45 revolutions for full extension. Note the grooves of the drum are in the form of a helix to assure single layer spacing and a precision lay down of cable. With ¼" cable and a 1/16" groove wall, the face of the drum would be approximately 13-14 inches wide. Although not shown on the drawing, a mechanism similar to 52 could be used to aid the lay down of cable.

Minor adjustments can be made in the shape of the drums on winches 36 and 24 each of which has only one layer of cable, versus the nine layers of cable on drum 16, to compensate for variances in the amount of cable played out. If the rate of rotation 36 and 24 are each directly proportional through reduction gears to the rotation of winch 16 there will be a slight mismatch since the inner layers of cable on drum 16 will play out slightly less cable than the outer layers on drum 16. By slightly increasing the radius of the grooves of drums 36 and 24 from one side of the drums to the other (±5%) in a linear fashion across the face of the drum, this variation can be equalized.

Finally, on the far left in the drawing, the three optional anchoring cables AC 45 could be played out from a unique tapered drum which compensates for difference in length of anchoring cables 5 as the tower ascends. The tangent of the angle between anchoring cable 6 and the ground is equal to the height of the tower represented by the length of cable 25 played out by drum 24, and the fixed distance between the base of the tower and the anchoring point of the cable to the side of the tower as shown in FIG. 1*e*. This anchoring point contains a pulley that allows anchoring cable 6, being played out from drum AC 45 to be routed through the pulley at the anchoring point up to the top of the tower, with cable 6 being played out proportionately to the height of the tower so that it remains relatively taut as the tower ascends.

Note there are three cables overlapping each other as shown in inserts 45*a* and 45*b* each coming off of the drum at 120 degree angle from each other, then routed through pulleys at the base of the tower (not shown) to the anchoring points at the side of the tower. The radius of the tapering of the helical grooves is designed such that the amount of cable played out equals the hypotenuse the right triangle formed by the length of cable 6, the length of cable 25 and the fixed distance between the tower base and the anchoring point. The length of cable 6 at any point is equal to the square root of the sum of the squares of cable 25 and the distance between the tower base and the anchoring point. Although not required, for the sake of convenience, the grooves in drum 45 can be so designed that one revolution of drum 45 corresponds to one revolution in drum 24, or 115 revolutions for full extension of cable 6.

Likewise, as with drum 24, the grooves of drum 45 are in the form of a helix to assure single layer spacing and a precision lay down of cable. With ¼" cable and a 1/16" groove wall, the face of the drum 45, like 24 would be approximately 13-14" wide. Although not shown on the drawing, a mechanism similar to 52 could also be used to aid the lay down of cable.

Distributed, Electronically Controlled Winches and Tensioning Mechanisms

If the winches are not linked mechanically and driven by a common motor and drive system with gearing to compensate for differences in winch rate of rotation, the alternative is a mechanical separation, with multiple motors driving multiple winches, with the control of play out and retraction electronically. This would require each motor to have its own encoder connected to a central microprocessor to record the number of revolutions for each winch with feedback loops to control the rates of revolution of each winch so that the cables are play-out and retracted in a coordinated fashion during EBS deployment. This electronically controlled system would have positive benefits, but also risks and perhaps added cost.

Figure 17:
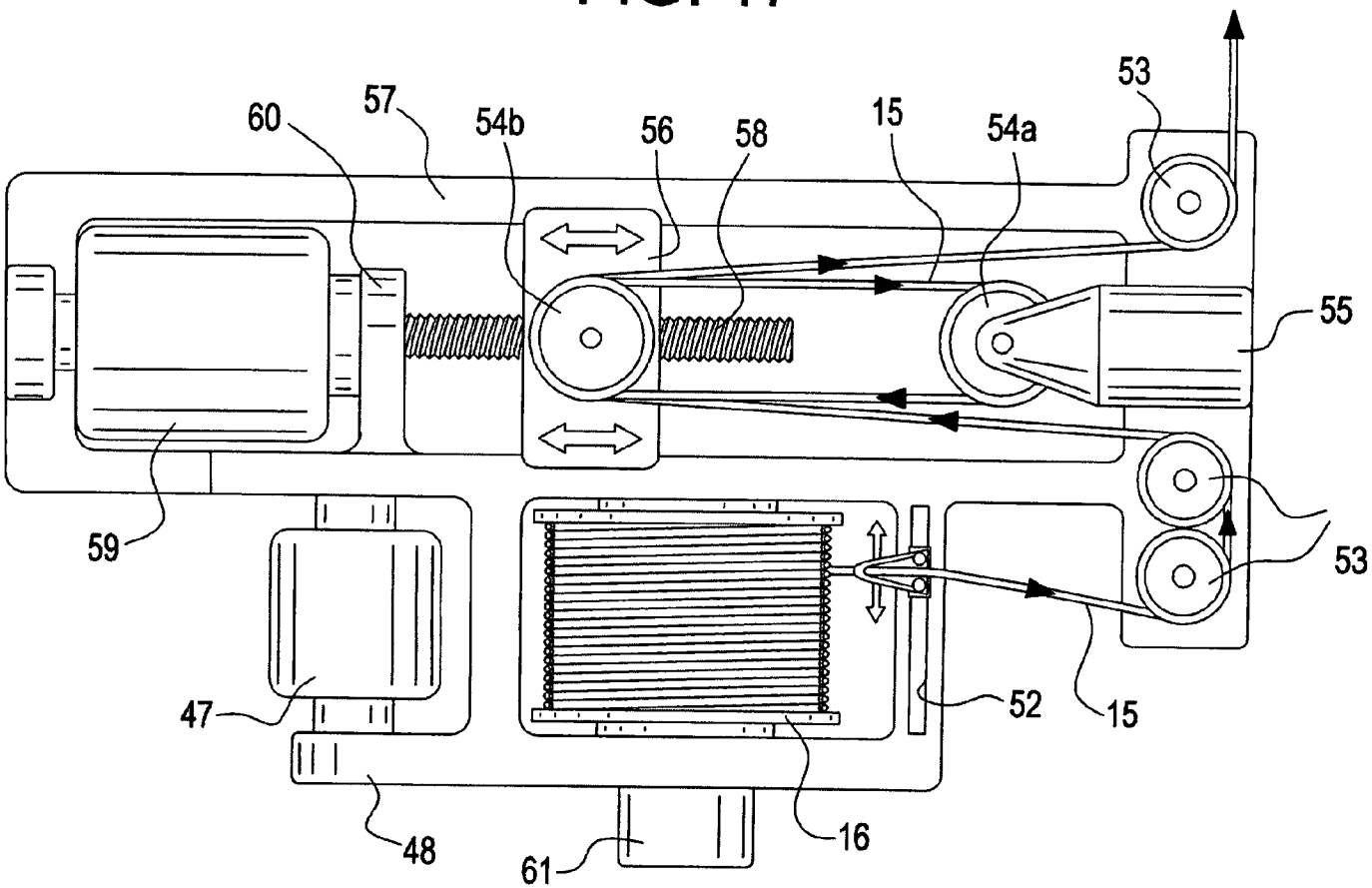
FIG. 17 shows an individual electronically controlled winch with a tensioning mechanism that mechanically tightens and loosens the cable.

FIG. 17 shows an individual electronically controlled winch with a tensioning mechanism that mechanically tightens and loosens the cable. The figure shows elements of the previous figure such as cable 15, winch drum 16, drive motor 47, winch drive 48, and cable lay down mechanism 52. Added to this figure are routing cables 53 that feed cable 15 through the tensioning pulleys 54 that contain several turns of cable. The tensioning pulley 54*a* on the right hand side is anchored to a strain gauge 55 that monitors the tension in cable 15. On the right side, the tensioning pulley 54*b* is attached to a sliding member 56 attached to but able to move along structural member 57, which is the frame that supports the tensioning mechanism. The slider 56 is propelled back and forth by screw 58, which is driven by reversible motor 59 through reduction gear 60. Strain gauge 55 provides a feedback loop to the computer to monitor how much tension is being placed on cable 15 and activate motor 59 to tighten or loosen cable 15 by driving tensioning pulley 54*b* back and forth. The encoder 61 monitors the amount of cable played out or retracted on drum 16.

Central computer controlling the operation of distributed winches would assure the proper ratios of cable are played out or retracted in the ratios dictated by the architecture, for example, in the 135 ft. tower case, the ratio of lengths for cables is 9:135:1305 for cables 32, 24, and 15 respectively. The play out of cable 45 could be computed as discussed previously as a length of cable equal to the square root of the sum of the squares of cable 25 and the distance between the tower base and the anchoring point.

Role of the Tensioning Mechanism

Tensioning mechanisms are provided for several reasons for both the mechanically integrated and the electronically integrated winch systems as described. A primary role is to allow the limited loosening of the cables when the EBS is ascending or descending in order to lesson the friction on pulleys and cables as the EBS is lengthen or shortened. When the EBS is extended to the desired length, which need not be the fully extended length, the EBS system can be "locked down" with all of the cables pulled taut and in tension so that the that the EBS system is at maximum rigidity. This is to minimize swaying or vibration of the payload platform, which may be required if it contains optical sensors, optical communications systems or RF transmitters or receivers (radars) requiring stable platforms. When lock down mode is required, the tensioning through the screw drive mechanism can exert thousands of pounds of tension.

The tensioning mechanism can also be used to take up slack if there is a slight variation in the amount of cable the four cabling systems if, in the mechanically integrated system, the winches did not dispense the exact amount of cable based on the mechanical gearing ratios. This can occur through small variations in drum radius, cable elongation due to cable aging, pulley maladjustment, etc. The tensioning mechanism can adjust and compensate for these length variances by adjustment in the slider shown in FIG. 17.

In a lockdown situation, both the external cabling network stabilizing the central beam (cables 5, 8 and 11), and the internal cabling systems associated with the central beam extension (15, 25 and 32) must be tensioned. By tensioning cable 5 at the base of the tower as shown in FIG. 1, the entire external cabling network itself will be tensioned since the tensioning of cable 5 will slightly rotate stays 3 downward around rotatable joints 12 and thus tension all of the fixed cables attached to the stay tips, which have a vertical component like diagonal cables 8 and 11. Tensioning at the base would be applicable for all stays rotated downward during initial deployment as shown for example in FIG. 2*c*. For all nested stays that were rotated upward during the initial deployment, shown for example in FIG. 14, cable 5 would be tensioned from the top of the tower while those rotated downward would be tensioned from the base of the tower.

The tensioning of all of the internal cabling systems can be accomplished by tensioning only cable 15 while other cable drums remain stationary. For the electronically controlled system this can be done by means of computer control. For the mechanically integrated system where all drums are mechanically linked with different fixed gear ratios, the shortening of cable 15 while all other cables remain stationary is accomplished by the tensioning system shown in FIG. 17. For both approaches, shortening cable 15 with other cables locked down will in effect put an upward force on the central beam, which in turn automatically tensions cables 25 and 32.

Other Applications of the EBS System Concept

Truck Mounted Mobile EBS System

Figure 18B:
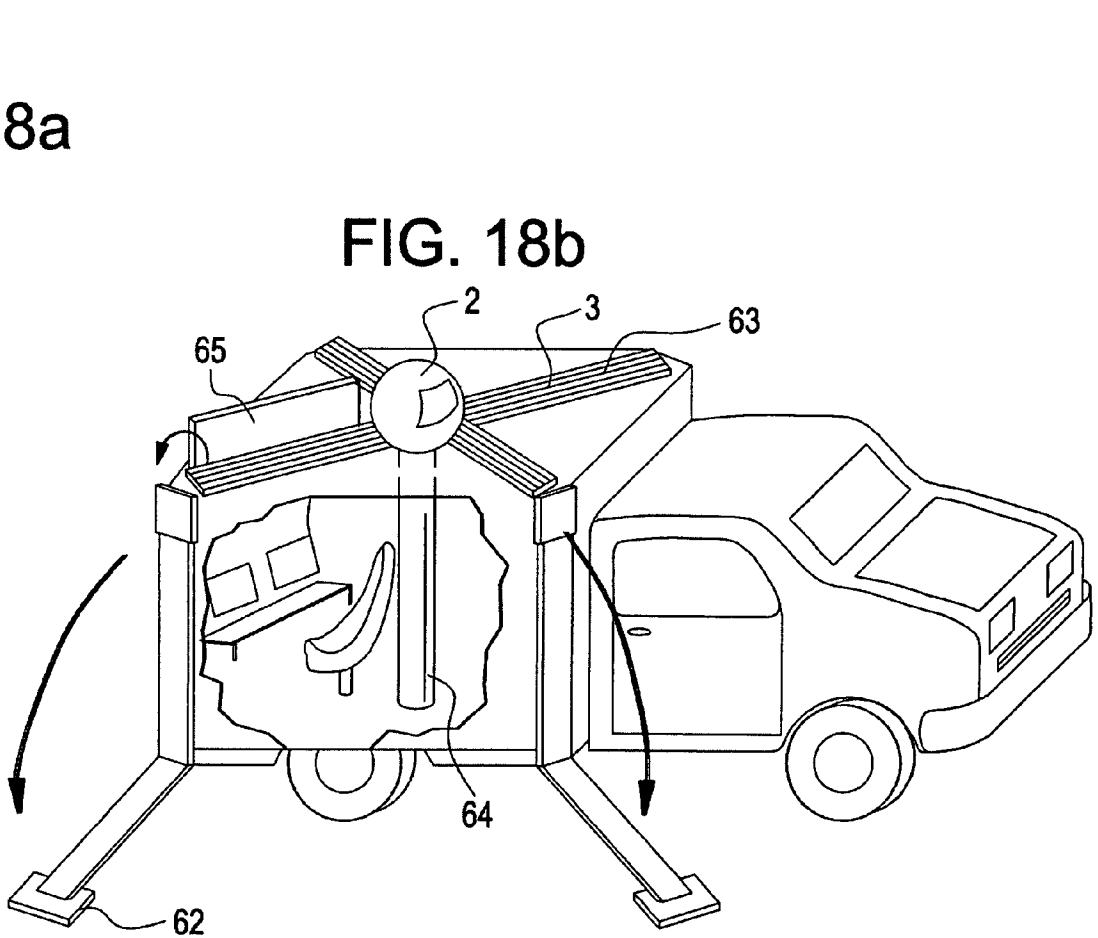
FIGS. 18*a* and 18*b* show a truck-mounted version of the EBS with a surveillance camera mounted on the top.
Figure 18A:
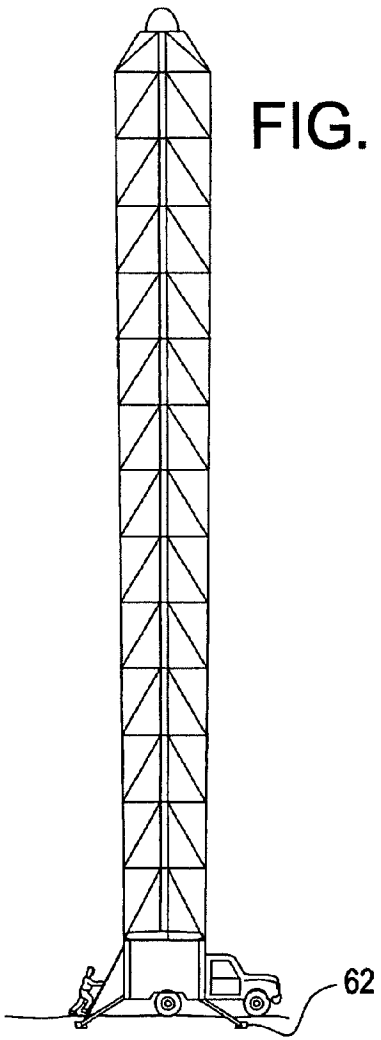

FIGS. 18*a* and 18*b* show at truck-mounted version of the EBS with a surveillance camera mounted on the top. The payload could as well be a line of sight microwave link as is commonly used by mobile TV news teams dispatched to remote locations to report a events. FIGS. 18*a* shows the extended beam and payload mounted to the top of a truck the elevation of which is 2× to 3× higher than is typically found in truck mounted extendable towers.

To add to the stability of the tower system, as is shown in FIG. 18*a*, feet 62 can be extended outward from the truck to the ground surrounding the truck as is commonly done with fire fighting ladder trucks, cranes, or electric power company repair trucks that elevate workers up to power lines with on a robotic arm. Because the payload is relatively light weight and streamlined there is no need for the diagonal anchoring cables 6 shown in previous figures although these could be added in a more permanent installation. The stay structures 3 and structure stabilizing network of cables plus the weight of the van at the base of the tower are more than adequate to maintain stability.

FIG. 18*b* shows a perspective view of the truck itself with a cutaway of the van containing a small control room. The figure shows the feet 62 extending downward with four sets of stays 3 mounted on the top of the van in trays 63, with the beam segments 4 telescoped into a well in the center of the van. In this configuration there is no need to rotate the nested stays into position during the initial deployment since they are already orthogonal to the central beam 4 and in position for extension of the beam. This allows the tower to be erected quickly at the deployment site.

During initial deployment, the beam segment package with payload attached, is elevated robotically during until the fixed diagonal cables 8 secured prior to beam extension in trays 63 are made taut. From this point on, the EBS extension is accomplished in a manner similar to that shown in previous figures, (e.g., FIGS. 1*d* and 1*e*). In order to protect the nested stays 3 against the weather during periods of storage or transport, hinged tray covers 65 could be provided which are rotated into an open position during deployment.

It is conceivable that a truck mounted EBS type system could be useful in fighting urban fires in tall buildings by extending ladders and water cannons vertically to heights well beyond those attainable with current hood and ladder truck technology. Also in the figure described above, once the feet are deployed, the section of the van shown in FIG. 18*b* containing the "control room" could be detached from the truck bed, and become a stand alone unit.

There are non truck-mounted variants of the EBS, which contain features of the system shown in FIG. 18. For example, a permanent tower flush with the ground containing surveillance cameras, lighting, or other security equipment could be stowed unobtrusively during the day but deployed after hours, at night, or when otherwise needed. In this case, the beam segments 3 would be stowed beneath the ground in a well similar to that shown as 64 in FIG. 18, with the nested stays in trays 63 covered by rotatable tray covers 65 at ground level or slightly below ground level, when in the stowed position.

Portable Bridging Equipment

Bridge Structure and Variants

Up to now, applications have been suggested that relate to a single central beam structure with 3 or 4 stays per level with network of cables to provide central beam stability against bending moments. Since the EBS concept is scalable and modular, it's conceivable that other terrestrial or space applications are possible with orientations that are vertical, horizontal or any orientation in between. Also, multiple central beams can be linked together to provide a variety of geometries that address specific requirements. This would be the case with a bridge application shown in FIGS. 19 through 22. This bridging system is transportable and can be deployed in less than an hour to provide temporary bridging for disaster relief or conventional military bridging applications, but with a system that is much lighter, more agile and transportable.

Figure 19A:
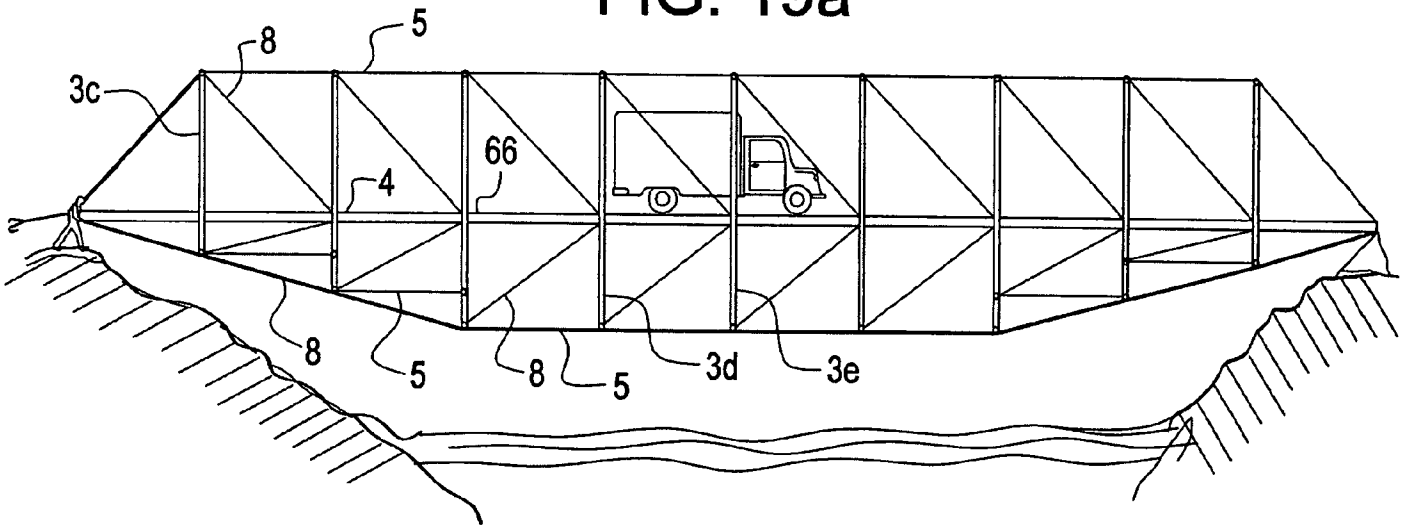
FIG. 19*a* is the side view of a fully deployed bridge.

FIG. 19*a* is the side view off a fully deployed bridge with stays 3 and networks of fixed length cables 8 and extendable cables 5 providing the stability to the two central beams 4 that provide lateral support for the bridge's roadbed 66.

Figure 19B:
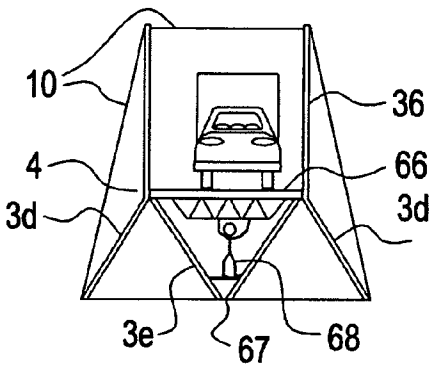
FIGS. 19*b* and 19*c* are front views of two variants of the deployed bridge.
Figure 19C:
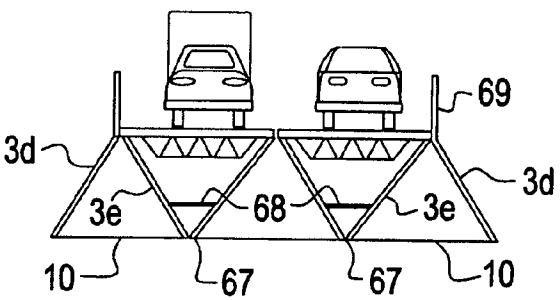

FIGS. 19*b* and 19*c* are front views of two variants. FIG. 19*b* is the front view of FIG. 19*a* where stays 3 and fixed length cables 10 along with fixed length cables 8 in FIG. 19*a* provide a trestle-like structure common in the railway industry, capable of supporting very heavy loads. Two stays from each of the two central beams are joined at the bottom at point 67 providing support for a pedestrian walkway 68. This walkway is useful during the deployment phase to support a worker making adjustments to the roadway structures shown in FIG. 20.

FIG. 19 *c* shows a two-way bridge, which has only the lower stay and cable support system, not the trestle-like structure. The weight of the roadway together with the angled disposition of the outer stays is sufficient to maintain tension in cables 10. Truncated stays 69, with cabling, can provide a side barrier to the roadway.

Dual Beam Structure and Stay Deployment

Figure 20C:
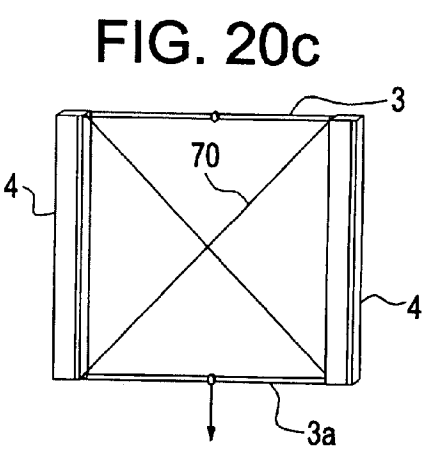
FIGS. 20*a-d* show how the two-beam system is deployed.
Figure 20B:
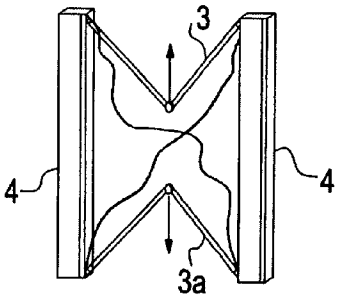
Figure 20A:
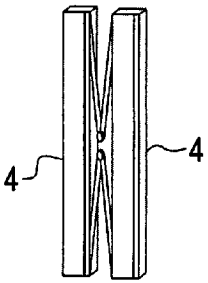

FIGS. 20*a-d* shows how the two-beam system is deployed. FIG. 20*a* shows a top view of two packages of nested beam segments 4 with nested stays; side by side, which would be the desired configuration when stowed on the truck carrying the bridging equipment to the deployment site shown in various stages of deployment in FIG. 22. At the deployment site, FIGS. 20*b* and 20*c* show the two packages of beam segments 4 being separated, with rigid hinged stays 3 top and bottom allowing the two central beams to be disposed in a planar configuration with diagonal cables 70 providing tensional support to align the beam segments in a parallel configuration.

FIG. 20 is a perspective view of the dual beam structure with nested beam segment packages 3 rotated in an outward direction until orthogonal to the central beam packages 4 with inner most deployed stays in the foreground jointed at point 67 and nested stays 3 hinged together in the background at point 71. This configuration is similar in many respects to that shown in FIG. 14*a*, with however an additional second beam structure (not shown) being the mirror image of that shown in FIG. 14*a*, with one pair of the three nested stay packages shown at the bottom of FIG. 14*a* joined (as seen at point 67 in FIG. 20*d*) and with the nested stay packages 3 at the top of FIG. 14*a* joined via hinges at with its mirror image stay package (as seen at point 71 in FIG. 20*d*).

Figure 20D:
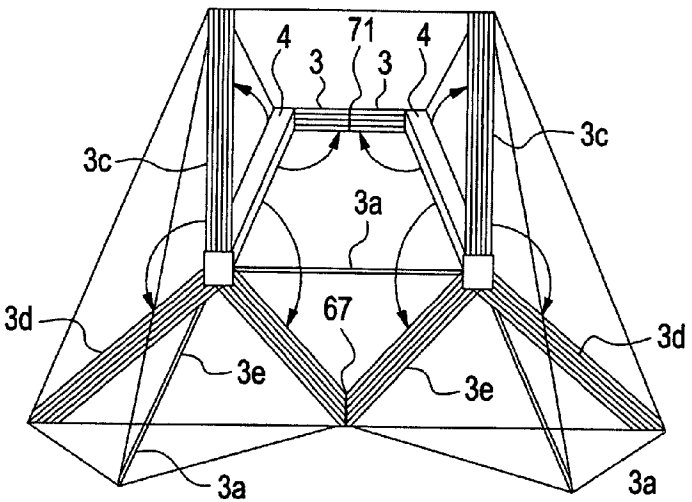

FIG. 20*d* also shows a single foremost stay 3*a*, which has been referred to previously as the leading stay described in FIGS. 2*b* and 2*c*. A more generalized view of the three nested stay configuration at one end of the beam segment, with one nested stay package at the opposite end are shown in FIGS. 15*e* and 15*f*.

Figure 21A:
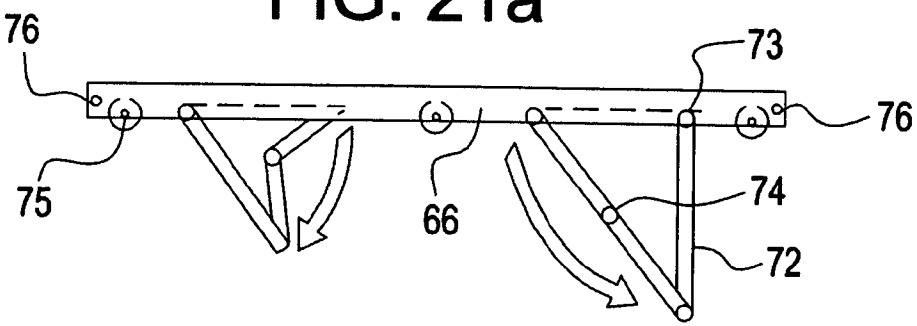
FIG. 21*a* is a side view of one of the roadbed segments with stiffening structures rotating downward for added support.

FIG. 21*a* is a side view of one of the roadbed segments 66 with stiffening structures 72 that rotate downward around hinge 73 and are locked into place with diagonal struts 74. These stiffening structures allow the road bed to support heavy loads transferring the loads to the beam structures running along the sides of the roadbed segments as shown in FIG. 21*b* and end view of the road bed being supported by the two central beam structures.

The roadbed segments contain load bearing rollers 75 that carry the load downward to the inner horizontal surfaces of the beam segments 4, with side looking alignment rollers 76 fore and aft that contact the inner side wall of the beam segments to provide lateral forces keeping the roadbed segments properly aligned.

Figure 21B:
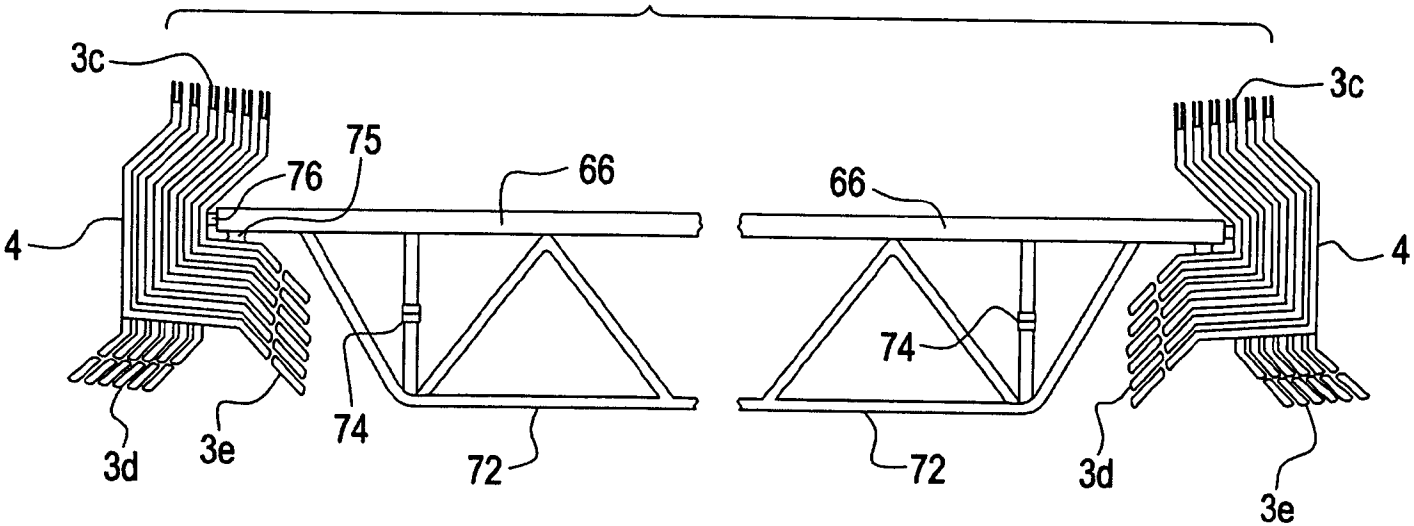
FIG. 21*b* shows a customized shape of the beam segments to support the roadbed segments.

The end view in FIG. 21*b* shows a customized shape of the beam segments 4 that are a modification of the high hat structures shown in FIGS. 6*c* and 6*d* and figures thereafter. The modification allows for the multiple beam segments to have a horizontal surface to accommodate load-bearing rollers 75 and a vertical surface to accommodate alignment rollers 76. Also shown in the figure are end views of the stowed nested stay packages 3*c*, 3*d*, and 3*e*. Stays 3*c* are rotated upward to a vertical position to form the upper trestle configuration in FIGS. 19*a* and 19*b* or the side barrier in FIG. 19*c*. Stays 3*d* angle outward to form the outboard stays 3*d* in the lower stay system in FIG. 19*b*, and stays 3*e* are the inboard stays, which are joined at the tips at point 67.

Onsite Deployment Process

Figure 22C:
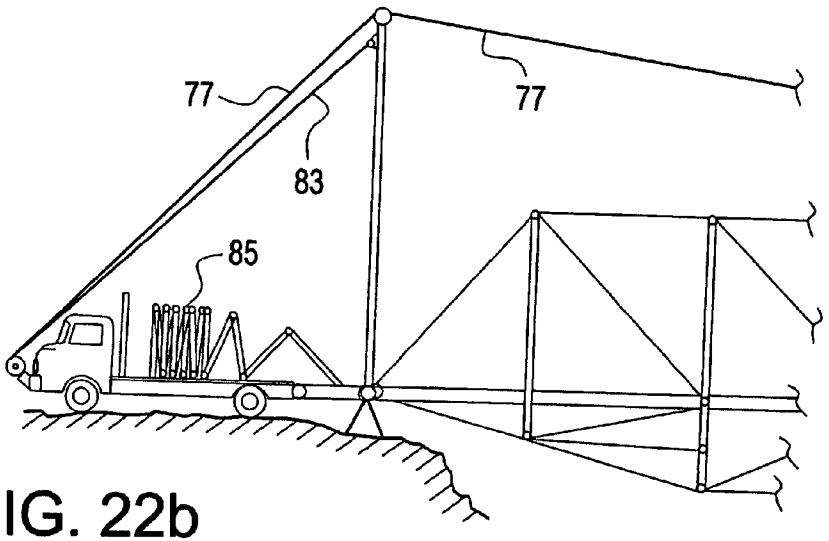
FIGS. 22*a-c* show step-by-step process for deployment of the bridge on-site from a truck, which carries both the EBS superstructure and the roadbed segments to the site.
Figure 22B:
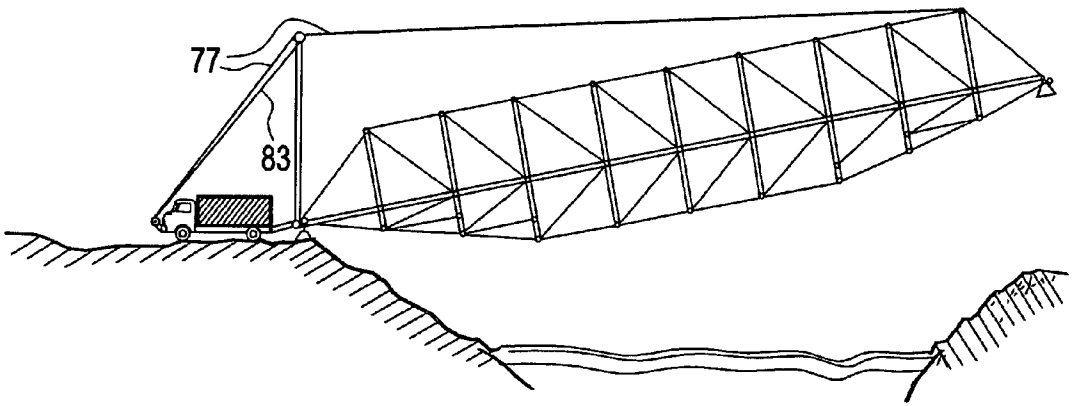
Figure 22A:
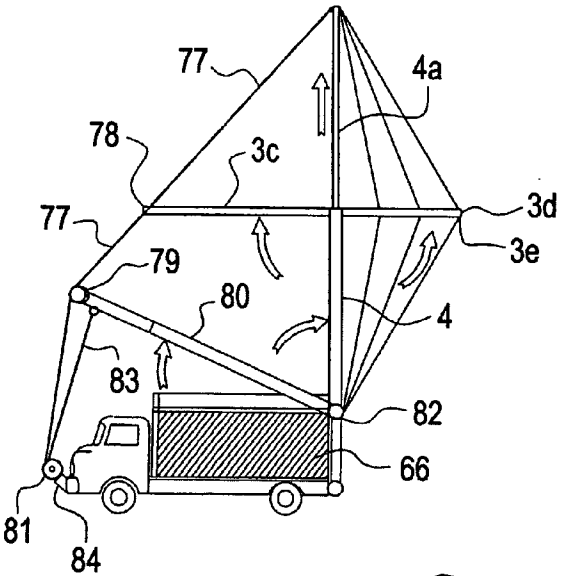

FIGS. 22*a-c* show step-by-step process for deployment of the bridge on-site from a truck, which carries both the EBS superstructure and the roadbed segments to the site. FIG. 22*a* shows the roadbed segment stowed vertically with the face of the roadbed parallel to the long side of the truck bed. FIG. 22*a* also illustrates the first stages of deployment where the dual nested beam segments 4 are rotated into a vertical position then deployed laterally as shown in FIGS. 20*a*, 20*b*, and 20*c*. Stay packages 3*c*, 3*d*, and 3*e* are then rotated outward and upward, with the simultaneous elevation of lead beam segment 4*a* with fixed length cables 8 attached.

A deployment crane is used to providing a lifting force to the end of the bridge as it is deployed across a river or valley and aid placement of the bridge footings on the opposite shore. This deployment crane consists of a deployment cable 77 attached to the leading stay at point 78, routed through pulley 79 attached to a telescoping crane mast 80 and ultimately anchored in winch 81. The winch is able to play out and retract cable as needed in the deployment process.

The crane mast is stowed horizontally during transit to the deployment site, but is elevated and rotated around hinge 82 through hydraulic or other means, with an angle of rotation appropriate for each stage of the deployment process, as the EBS superstructure is extended over the river or other obstacle. A secondary mast cable 83 and independent winching system 84 provides additional restraining force on the mast when it is rotated to the vertical position as shown in FIG. 22*b*, and must sustain very substantial loads from the deployment cable when the bridge is in a near horizontal position during deployment.

FIG. 22*b* illustrates a fully extended bridge prior to its placement on the opposite shore, with telescoping mast 80 in a near vertical orientation, the deployment cable approximately horizontal, and the bridge itself being positioned to drop onto the opposing shore.

The front of the truck may be staked to the ground to oppose the rotational forces induced by cable 77 when the bridge superstructure is fully extended and in the near horizontal orientation. But this is probably not necessary. The bridge superstructure is extremely light weight relative to the weight of the roadbed segments which are still loaded in the truck, and make up the largest portion of the overall weight of the bridge, approximately 70-80%. Included also in the moment of force opposing the bridge superstructure moment is the weight of the truck itself, its engine, and weight of the stowed roadbed segments.

FIG. 22*c* is a side view of the truck illustrating deployment of the roadbed segments 66. Roadbed segments have been rotated 90 degrees in the horizontal plane, exposing the side view of the package of segments, which are alternately hinged 85 and folded like an accordion. During deployment, cables linked to winches on the opposite end of the bridge draw out the hinged roadbed segments onto the tracks of the dual beam support structure, aided by the load bearing rollers 75, and alignment rollers 76. This process continues until the all of the segments are laid out and secured to the bridge superstructure. Alternatively, individual roadbed segments, without hinges, could be stowed horizontally on the truck and dispensed individually onto the tracks of the dual beam support structure.

It should be noted that because of the architecture of the EBS system, that an EBS bridge can be extended to any length short of its maximum extension if, for example, if the river or obstacle to be bridged is not as wide as that shown in the figures. Furthermore, the EBS concept is modular, meaning more than one bridge superstructure can be deployed to double or triple the length of the bridge. This would require a float system or temporary pilings be established in the river at the opposite end of the first bridge superstructure deployed. Another deployment truck, then using the bridge itself could back to the end of the bridge and begin deploying the second bridge superstructure.

Solar Array Deployment in Space

FIGS. 23*a-e* shows the deployment of a large solar array in space using the EBS system. Photovoltaic solar cells attached to a flexible membrane are rolled onto a drum in the stowed configuration. EBS structures along each side of the stowed package provide a controlled extension of the solar array until it is fully deployed.

Figure 23A:
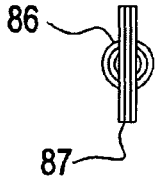
FIGS. 23*a-e* show the deployment of a large solar array in space using the EBS system.
Figure 23B:
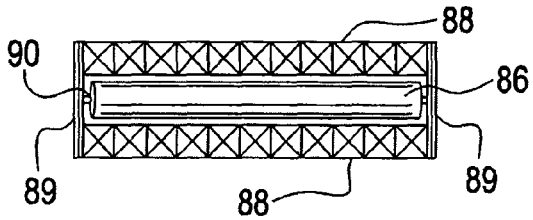
Figure 23C:
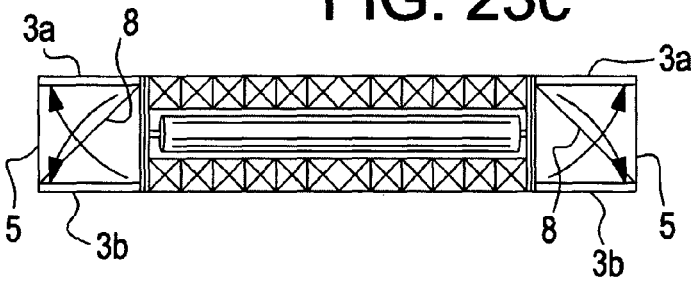
Figure 23D:
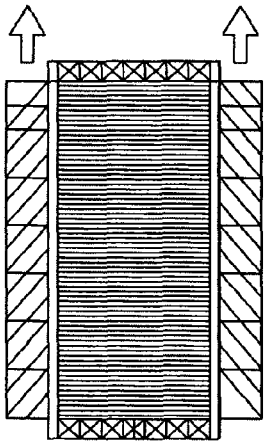
Figure 23E:
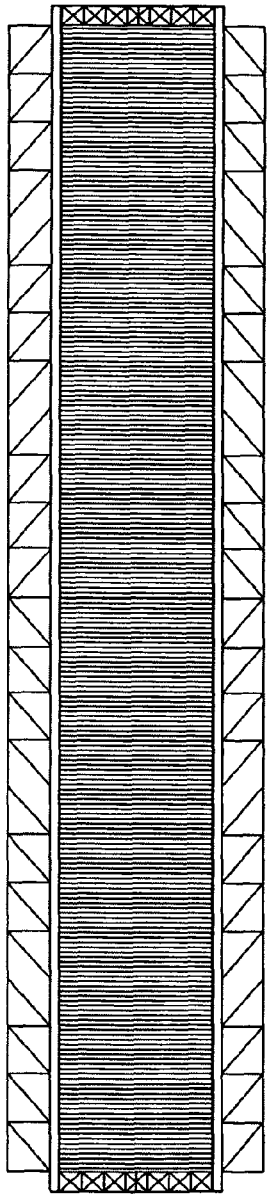

FIG. 23*a* is a side view of the stowed package with the rolled up PV membrane 86 and deployment structure 87. FIG. 23*b* is a front view of the stowed array with rolled up PV membrane 86, rigid truss beams 88 on each lengthwise side of the drum, EBS structures 89 at each end of the drum, and roller bearing 90 allowing the drum to rotate during deployment. FIG. 23*c* shows the initial deployment of the EBS with robotic rotation of the leading stays 3*a* and trailing stays 3*b* at each end of the drum, stretching taut fixed length diagonal cables 8 and extendable cables 5. FIGS. 23*d* and *e* show respectively the solar array system in mid and full deployment. This same basic design can be used whether the solar array blanket is rolled onto a drum, or is folded like an accordion into a storage container or locker prior to deployment. Also the design in not limited to solar arrays and could be used to dispense large membrane radar antennas.

Summary of EBS Principles

Although the applications shown above are quite varied, the fundamental EBS principles are common to each that is: 1) one or more central beam packages contain nested beam segments can be extended by mean of internal pulleys and cables that when retracted, extend the beams; 2) support stays and a network of fixed length and variable length cables that maintain the rigidity of the central beam during and after deployment; 3) winches that play out and retract the various cabling systems as required; 4) in a variant mode of beam extension, described as "Simplified Semiautonomous," the complex internal cables and pulleys for beam extension and control as described in 1) are replaced by a mechanical system, external to the nested beam segments, which provide an external force to sequentially raise and lower beam segments to extend and retract the EBS.

While the invention has been described with reference to specific embodiments, modifications and variations of the invention may be constructed without departing from the scope of the invention.

I claim:

1. Extendable beam system comprising plural side by side rigid plates, connected for relative sliding until the plates are fully extended in a beam, angular extensions attached to each rigid plate, short diagonal cables connected between outer ends of the angular extensions and parts of the rigid plates remote from the angular extensions, longitudinal cables attached to outer ends of the angular extensions, whereby the short diagonal cables are tensioned when the angular extensions are extended from the plates, and the longitudinal cables are tensioned as the angular extensions are extended from the rigid plates and as the beam is being extended and when the rigid plates are fully extended in the beam, and wherein the longitudinal cables are tensioned while the rigid plates in the beam are being extended or retracted.

2. The system of claim 1, wherein the angular extensions are fold-out extensions having inner ends hinged to the rigid plates and having the outer ends remote from the plates, and wherein the short diagonal cables are tensioned when the fold-out extensions are fully folded out.

3. The system of claim 2, wherein the longitudinal cables are moved outward from the rigid plates as the extensions are folded outward from the rigid plates.

4. The system of claim 2, wherein each plate has plural fold-out extensions and plural short diagonal cables for forming a three-dimensional structural element with each rigid plate, the plural fold-out extensions connected to the plate and the short diagonal cables connected between outer ends of the extensions and remote portions of the plate, and the longitudinal cables attached to the outer ends of the extensions.

5. The system of claim 1, wherein the plates have three-dimensional rigid plates and each rigid plate does not surround or circumferentially enclose an adjacent plate.

6. The system of claim 1, wherein the extensions are rigidly connected to the plates.

7. The system of claim 1, wherein the extensions extend from the plates in three or more angularly related senses of direction with respect to the plates.

8. The system of claim 1, wherein the beam is extended vertically as a tower.

9. The system of claim 8 further comprising anchors positioned away from the beam and outrigger cables connected between the anchors and the outer ends of some of the extensions for stabilizing the tower.

10. The system of claim 1 wherein the beam extends vertically and is deployed horizontally as a bridge, and further comprising a roadway having connected planar parts for connecting to the plates as a travelway.

11. The system of claim 1 further comprising lower and upper guides on the plates, at least one beam-extending cable extended around the guides, and a winch connected to the at least one beam-extending cable for pulling the beam-extending cable and drawing the lower guides on the plates toward the upper guides on adjacent plates, and thereby extending the beam.

12. The system of claim 11 wherein the guides are freely rotating pulleys, around which the beam-extending cable passes.

13. The system of claim 12 further comprising pulleys near outer ends and inner ends of the extensions, wherein the longitudinal cables comprise plural short longitudinal cables having upper ends connected to the outer ends of upper extensions and passing around the pulleys on lower extensions and connected to the plates for tensioning the short longitudinal cables upon extension of the beam.

14. The system of claim 1 further comprising guides at upper ends of the plates and plural beam-extending cables having intermediate portions passing around the guides on intermediate plates and having opposite ends connected to lower parts of adjacent plates on opposite sides of the intermediate plates and a similar lower beam-extending cable passing around guides on an end plate and having a first end connected to a lower end of the next adjacent plate and a second end connected to a winch for taking in and shortening the lower beam-extending cable and extending the next adjacent plate and thereby concurrently extending the remaining plates with the plural beam-extending cables.

15. The system of claim 1 further comprising unit cross extension cables extending between outer ends of extensions connected to each of the plates.

16. The system of claim 1 further comprising anchors and anchor cables connected to the beam and passing around the anchor cables, guides on the plates, beam-extending cables passing around the guides, coordinated winches for taking in at least one of the beam-extending cables while paying out the longitudinal cables and paying out the anchor cables.

17. The system of claim 16 further comprising tensioners for tensioning the anchor cables after the beam is extended.

18. The system of claim 1 wherein the plates are arranged in parallel spaced relationship for extending as two beams.

19. The system of claim 18 further comprising intermediate extensions hinged to the plates and extending between opposite plates, the intermediate extensions having medial hinges for straightening the intermediate extensions as they are fully extended to space the two beams.

20. The system of claim 19 wherein the two beams are extended and fixed horizontally and further comprising a roadbed extended between the two beams.

21. The system of claim 20 wherein the road bed is stored in accordion form with hinged interconnected sections.

22. A beam extension system comprising plural structural units, plural slideable rigid plate elements in the structural units, the slideable rigid plate elements being arrangeable end to end as a beam, extensions connected to each of the rigid plate elements in each structural unit, diagonal cables connected between outer portions of the extensions and the rigid plate elements to which the extensions are attached, transverse cables connected between outer portions of the extensions on each rigid element, and longitudinal extendable cables connected to outer ends of the extensions on adjacent rigid plate elements.

23. An extendable beam structure comprising a central beam formed of slideable open nested parallel plates, wherein one plate does not circumferentially enclose or surround another adjacent plate, with pivoted perpendicular extensions from the central beam, a network of supporting cables connected to the central beam and to the pivoted extensions that support the central beam when extending and extended against bending and torsion moments, and maintain axial rigidity of the central beam.

24. The structure of claim 23 wherein the central beam further comprises a plurality of rigid plate beam segments and restraining parts that are stowed in a compact form with the rigid plate beam segments aligned parallel to each other, wherein the rigid plate beam segments are connected to each other through the restraining parts that grip one end of each or the rigid plate beam segments with an opposite end of an adjacent rigid plate beam segment.

25. The structure of claim 24 further comprising tracks in the rigid plate beam segments and wherein during deployment the rigid plate beam segments slide past each other and the restraining parts slide along the tracks in the rigid plate beam segments and maintain a constant restraining force linking the one end of each rigid plate beam segment with the opposite end of the adjacent rigid plate beam segment.

26. The structure of claim 23, wherein the beam extensions are linked to the rigid plate beam segments through hinges that allow the beam extensions to be stowed parallel to the rigid plate beam segments then to be automatically rotated outward during deployment until the beam extensions are perpendicular to the rigid plate beam segments.

27. The structure of claim 26 wherein the network of cables further comprises fixed length cables connected from a tip of each beam extension to an adjacent beam extension in a plane orthogonal to the central beam, and wherein the rotation outward of the plurality of beam extensions makes taut the fixed length cables.

28. The structure of claim 26 wherein the network of cables further comprises diagonal fixed length cables extending from a tip of each beam extension to an opposite end of each rigid plate beam segment that supports the beam extension, and wherein the diagonal fixed length cables are made taut by the outward rotation of the beam extensions.

29. The structure of claim 26 wherein the network of cables further comprises extendable cables that connect a tip of each beam extension connected at a base of a rigid plate beam segment with a top of a beam extension at a base of a neighboring rigid plate beam segment, wherein the extendable cables during the deployment play out from the tip of one beam extension to the tip of the beam extension at the neighboring rigid plate beam segment, with a length of the played out cable equal to a relative length of travel of one rigid plate beam segment sliding past a neighboring rigid plate beam segment.

30. The structure of claim 26 wherein the network of cables further comprises extendable cables anchored at one end of a rigid plate beam segment, traveling through a series of pulleys, through the hinged area at an opposite end of the segment, through base of the beam extension on the base, through the beam extension to its tip and is connected to a tip of an adjacent beam extension structure where the extendable cable is played out as the segments slide past each other during the deployment phase.

31. The structure of claim 23, wherein deployment of the central beam is driven by extending each rigid plate beam segment relative to its neighboring segment by an external force, wherein extension of the rigid plate beam segments is in a sequential manner with each segment in turn extended relative to a neighboring segment, with one end of a segment affixed to an opposite end of the neighboring segment by a locking mechanism.

32. The structure of claim 23, wherein deployment of the central beam is driven by extending each rigid plate beam segment relative to its neighboring segment by means of an internal beam extension cable and pulleys wherein retraction of the beam extension cable connecting one end of a base segment with the other end of an adjacent segment propels one segment to slide past the adjacent segment, and wherein the retraction of the cable is powered by a motorized winch, wherein extension of the beam is executed simultaneously with the retraction of the internal beam extension cable forcing each beam segment to slide past its neighbor segment.

33. The structure of claim 32, wherein extension of each segment is restrained by a system wherein a first cable running from a first segment travels through pulleys to the opposite end of a second adjacent segment and down to a base of a third base segment where the first cable is anchored, a separate second cable attached to a base of the second plate running through pulleys at an opposite end of the first base plate is retracted by a winch, causing the controlled extension of the second base segment by an amount equal to the length of the cable retracted, wherein the motion of the second base segment relative to the first segment has the effect of extending the third segment relative to the second segment, by means of the first cable which by the extension of second segment shortens a length of the first cable relative to the third segment by an amount which is equal to the length of cable retracted by the winch, wherein the same process is extended to each segment pair such that the beam extension process is controlled such that the extension of each pair is equal to a length of cable refracted by the winch, and thus each beam segment is extended by an equal amount.

34. The structure of claim 23 wherein lengths of the perpendicular beam extensions is determined by requirements of cables attached to outer tips of the extensions, so that the cables are not fouled during extension of the central beam.

35. The structure of claim 24, wherein the beam extensions and fixed length cables are anchored to orthogonal nested extensions at each end of the nested beam segments that allow attachment points on three sides at each end of bases of the segments.

36. The system of claim 1, wherein each longitudinal cable is attached near a top of a first rigid plate, extends through guides on an extension attached to a second above plate, and is connected near an outer end of an extension attached to a third above plate.

* * * * *